US011230870B2

(12) United States Patent
Rotondi

(10) Patent No.: US 11,230,870 B2
(45) Date of Patent: Jan. 25, 2022

(54) FENESTRATION HARDWARE SYSTEM FOR CASEMENT WINDOWS

(71) Applicant: Anthony J. Rotondi, Surprise, AZ (US)

(72) Inventor: Anthony J. Rotondi, Surprise, AZ (US)

( * ) Notice: Subject to any disclaimer, the term of this patent is extended or adjusted under 35 U.S.C. 154(b) by 478 days.

(21) Appl. No.: 16/386,050

(22) Filed: Apr. 16, 2019

(65) Prior Publication Data

US 2019/0316404 A1 Oct. 17, 2019

Related U.S. Application Data

(60) Provisional application No. 62/658,065, filed on Apr. 16, 2018.

(51) Int. Cl.
*E05F 11/22* (2006.01)
*E05D 15/58* (2006.01)

(52) U.S. Cl.
CPC ..... *E05F 11/22* (2013.01); *E05D 15/58* (2013.01); *E05Y 2201/684* (2013.01); *E05Y 2201/688* (2013.01); *E05Y 2900/148* (2013.01)

(58) Field of Classification Search
CPC . E05F 11/16; E05F 11/18; E05F 11/20; E05F 11/22
See application file for complete search history.

(56) References Cited

U.S. PATENT DOCUMENTS 4,392,330 A * 7/1983 Buhr ..... E05D 15/30 160/92
4,679,352 A * 7/1987 Bates ..... E05D 15/30 49/192
4,823,508 A * 4/1989 Allen ..... E05D 15/30 49/252
4,945,679 A * 8/1990 Aumercier ..... E05F 11/34 49/342
8,046,954 B2 * 11/2011 Curtis ..... E05D 15/48 49/249
8,434,265 B1 * 5/2013 Campbell ..... E05D 15/42 49/250
9,512,657 B2 * 12/2016 Yeung ..... E05F 11/08
10,072,452 B2 * 9/2018 Carrier ..... E05C 9/021
(Continued)

FOREIGN PATENT DOCUMENTS

CN 105735806 A * 7/2016 ..... E05D 15/30
DE 1708852 B1 * 10/1970 ..... E05D 15/5205
DE 202015001032 U1 * 4/2015 ..... E05D 15/30
(Continued)

*Primary Examiner* — Catherine A Kelly
(74) *Attorney, Agent, or Firm* — Keith Miller Patent Law, PLLC; Keith Miller

(57) ABSTRACT

Operating hardware for a window complete comprising an upper platform unit attached to a window frame; a lower platform unit attached to the window frame; a sliding drive mechanism comprising a sliding housing base, a sliding housing top piece, a planetary gear set, and a worm and wheel gear set; and a handle drive mechanism comprising an input bevel gear, a handle drive cap including a first hole for receiving the input bevel gear and a first half hole, an output drive gear, a handle drive base including a second hole for receiving the input bevel gear and a second half hole, and a handle drive shaft.

16 Claims, 18 Drawing Sheets

(56) References Cited

U.S. PATENT DOCUMENTS

| | | | | |
|---|---|---|---|---|
| 10,676,977 | B2 * | 6/2020 | Erickson | E05F 11/16 |
| 11,091,940 | B2 * | 8/2021 | McGregor | E05F 5/06 |

FOREIGN PATENT DOCUMENTS

| | | | | |
|---|---|---|---|---|
| DE | 102017206449 | A1 * | 10/2018 | H01T 21/06 |
| GB | 2416190 | A * | 1/2006 | E05D 15/30 |
| WO | WO-0229192 | A2 * | 4/2002 | E05F 15/622 |

* cited by examiner

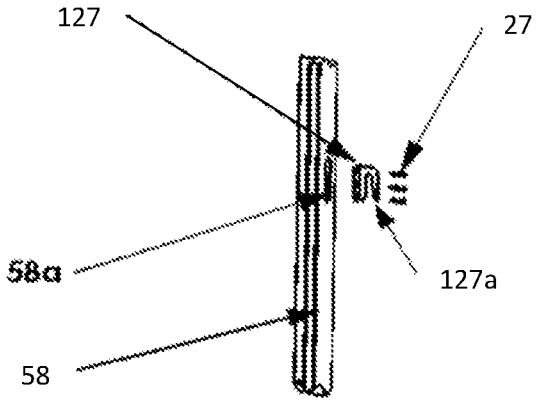
FIG.12A
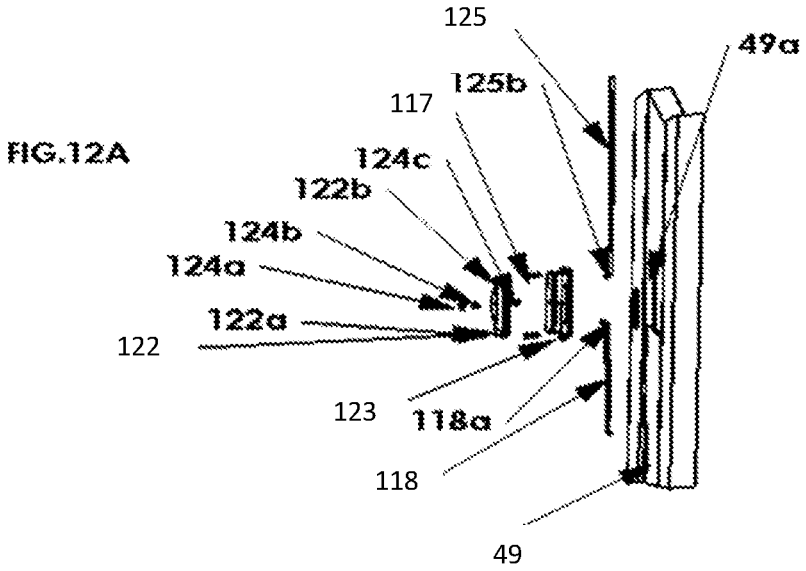
FIG.12A
FIG. 12B

FENESTRATION HARDWARE SYSTEM FOR CASEMENT WINDOWS

CROSS-REFERENCE TO RELATED APPLICATIONS

The present application is related to and claims priority from prior provisional application Ser. No. 62/658,065, filed on Apr. 16, 2018, entitled "FENESTRATION HARDWARE SYSTEM FOR CASEMENT WINDOWS," the contents of all of which are incorporated herein by reference and are not admitted to be prior art with respect to the presently claimed invention via the mention in this cross-reference section.

FIELD OF THE INVENTION

The present disclosure relates to windows and more particularly, to a window operator or hardware system for use in casement windows.

BACKGROUND

Casement window operators are well known in the art and typically utilize a hand crank to perform a single operation, for example, the opening and closing of a casement window. Another type of casement window operator uses a hand crank to lock and unlock a window sash within a window frame of a casement window. While attempts have been made to create an integrated window hardware system that combines the operation of a single hand crank to control a window's swing for opening and closing, linked to the operation of locking and unlocking the window, significant mechanical issues have resulted.

An exemplary mechanical issue resulting from integrated systems stems from an uneven or unsure back pressure created at the window's sash seal. That is, during the mechanical transitions between the operational mode and the locking mode, a resulting back pressure causes a misalignment of the window. Such a misalignment event, is otherwise mechanically defined as the release point between the sash's hook and the window's latch, wherein any back pressure from the sash seal pushes the sash away from the window frame, creating the misalignment event.

Recent U.S. Pat. No. 8,141,295 B2 (2012) is a representation of an attempt to use a single hand crank to control both the locking and unlocking operation, linked directly to the operation of the opening and closing of the sash. However, this and other known recent disclosures fail to address or take into consideration the misalignment problem described above.

Additional casement window operators or hardware in an integrated system may further include use of the hand crank to cause a window to enter a wash mode. Currently known window hardware for providing a transition of a window into a wash mode requires a window operator to have extra knowledge about the window hardware as a complete system, and extra knowledge is considered a highly undesirable condition as described in U.S. Pat. No. 8,707,621 B2 (2014) and U.S. Pat. No. 8,141,295 B2 (2012), which teach a wash mode for their windows which still requires particular hand manipulation to place the window sash in the position for cleaning.

Accordingly, there exists a need to provide an integrated casement window operator or hardware system that allows use of a single hand crank to control both an operational mode and a locking mode that overcomes the identified misalignment problem. There further exists a need to provide a window casement hardware system having an operational mode, a locking mode, and a wash mode, all connected to a single hand crank.

SUMMARY

An embodiment of this disclosure provides an Operating hardware for a window complete comprising an upper platform unit attached to a window frame, the upper platform unit comprising an upper platform base, an upper guide track, and an upper link arm mechanism configured to attach the upper link arm mechanism to a window sash; a lower platform unit attached to the window frame, the lower platform unit comprising a lower platform base, a first lower guide track, a second lower guide track wider than the first lower guide track, and a lower link arm mechanism, wherein the lower link arm mechanism is attached to the window sash; a sliding drive mechanism comprising a sliding housing base, a sliding housing top piece, a planetary gear set, and a worm and wheel gear set, wherein the planetary gear set is positioned between the sliding housing top piece and the sliding housing base, wherein the worm and wheel gear set comprises a wheel gear mounted to the planetary gear set, and a worm gear positioned between the sliding housing top piece and the sliding housing base and coupled to the wheel gear, and wherein the sliding housing top piece is secured to the sliding housing base; and a handle drive mechanism comprising an input bevel gear, a handle drive cap including a first hole for receiving the input bevel gear and a first half hole, an output drive gear, a handle drive base including a second hole for receiving the input bevel gear and a second half hole, and a handle drive shaft, wherein the output drive gear is mounted to the handle drive shaft and disposed within the first half hole and the second half hole; wherein the handle drive mechanism is mounted to the second lower guide track of the lower platform unit; and wherein the sliding drive mechanism is configured to freely slide within the second lower guide track of the lower platform unit.

BRIEF DESCRIPTION OF THE DRAWINGS

Figure 1:
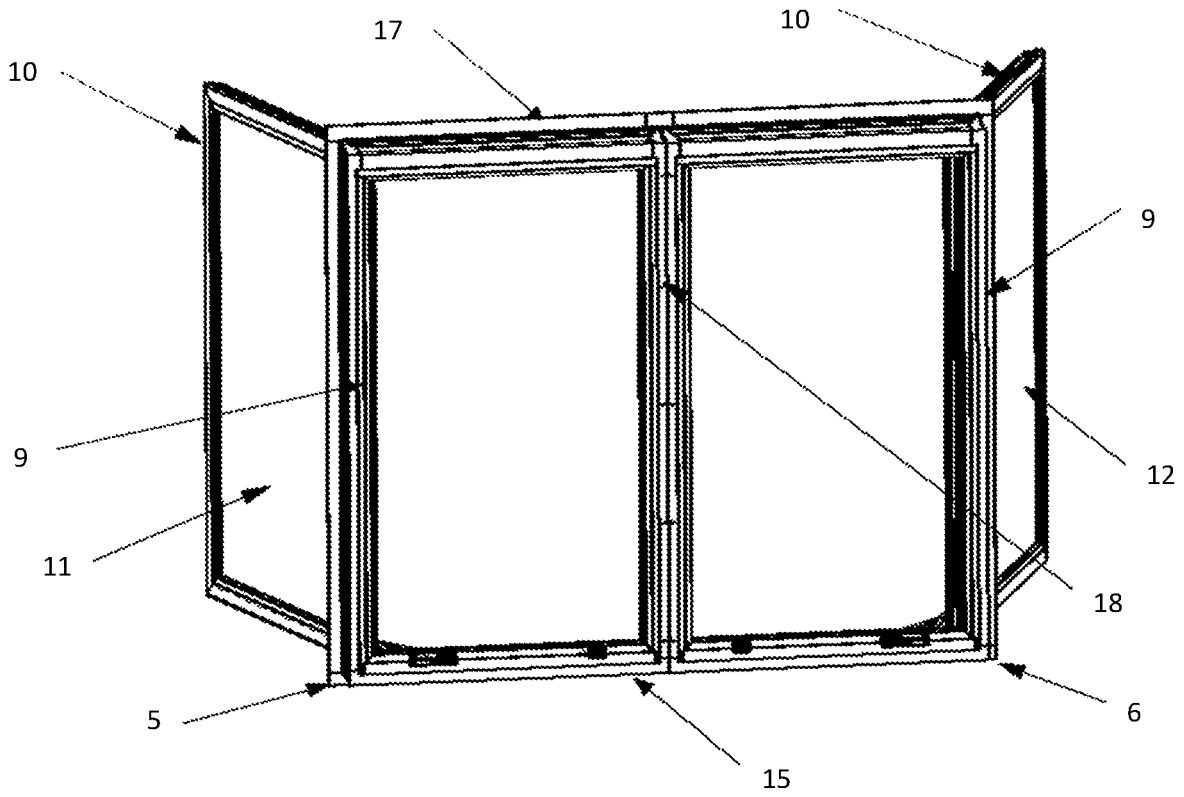
Figure 2:
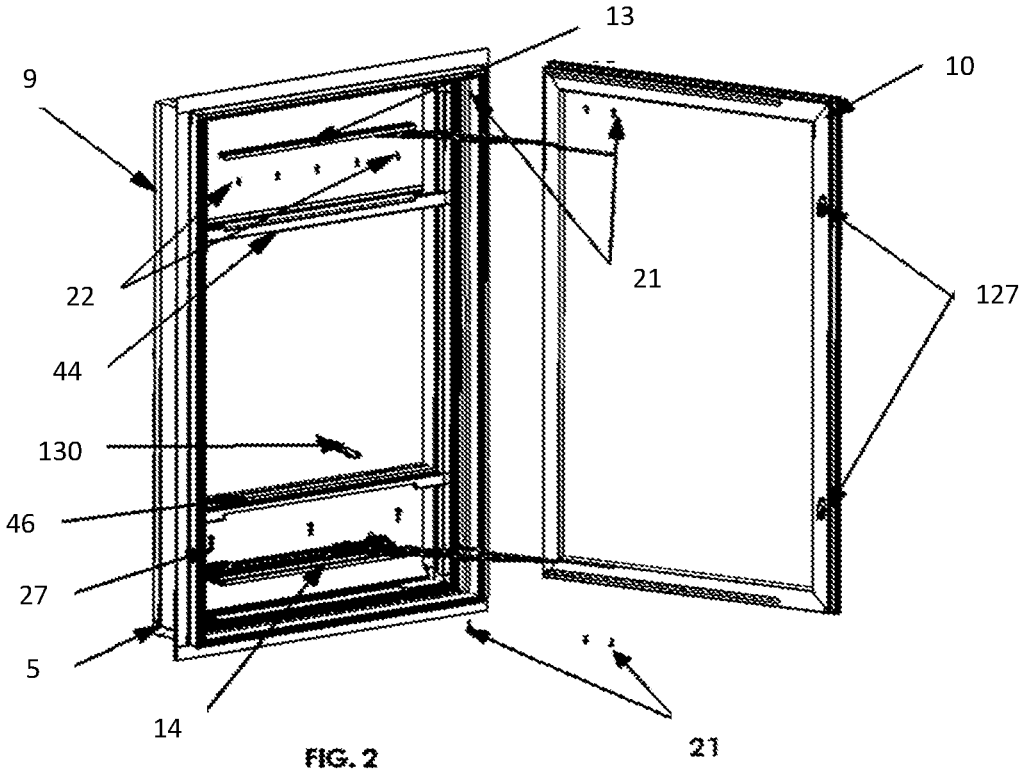
Figure 3A:
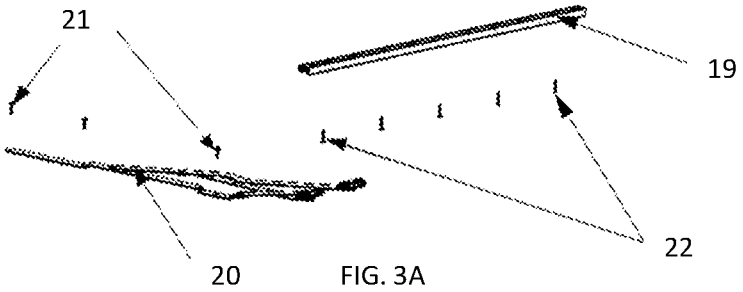
Figure 3B:
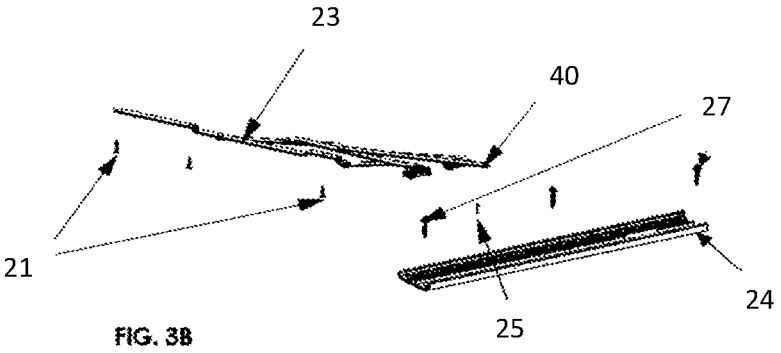
Figure 4:
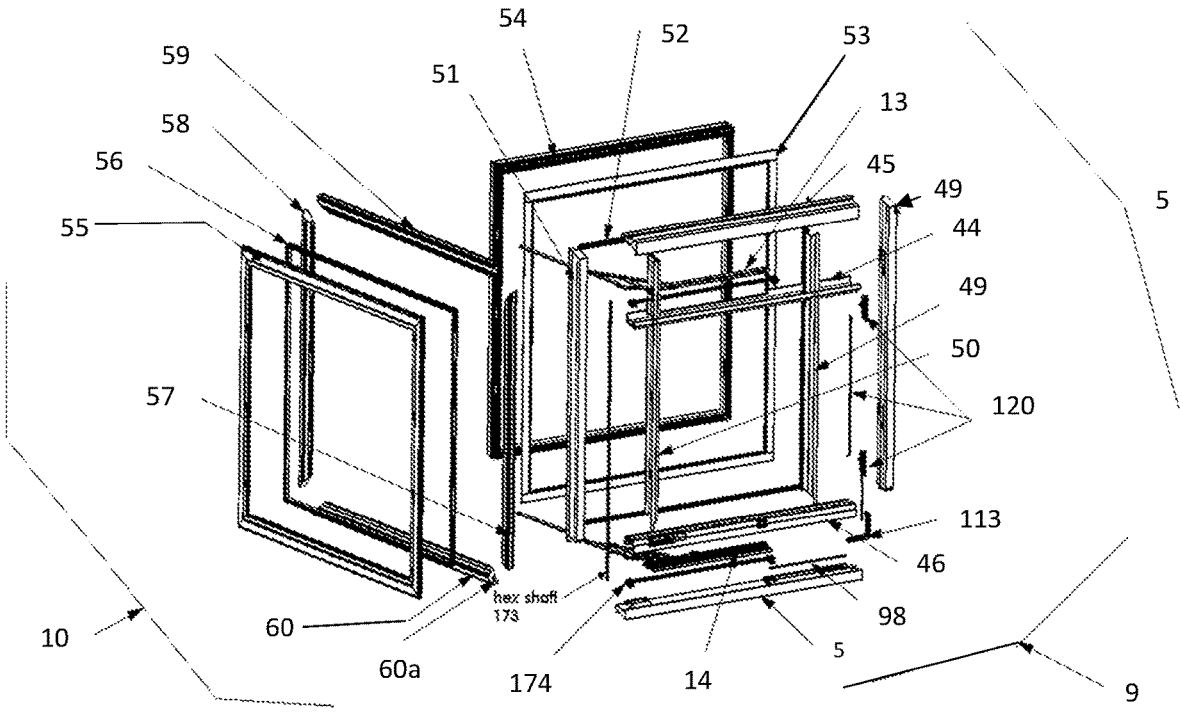
Figure 5:
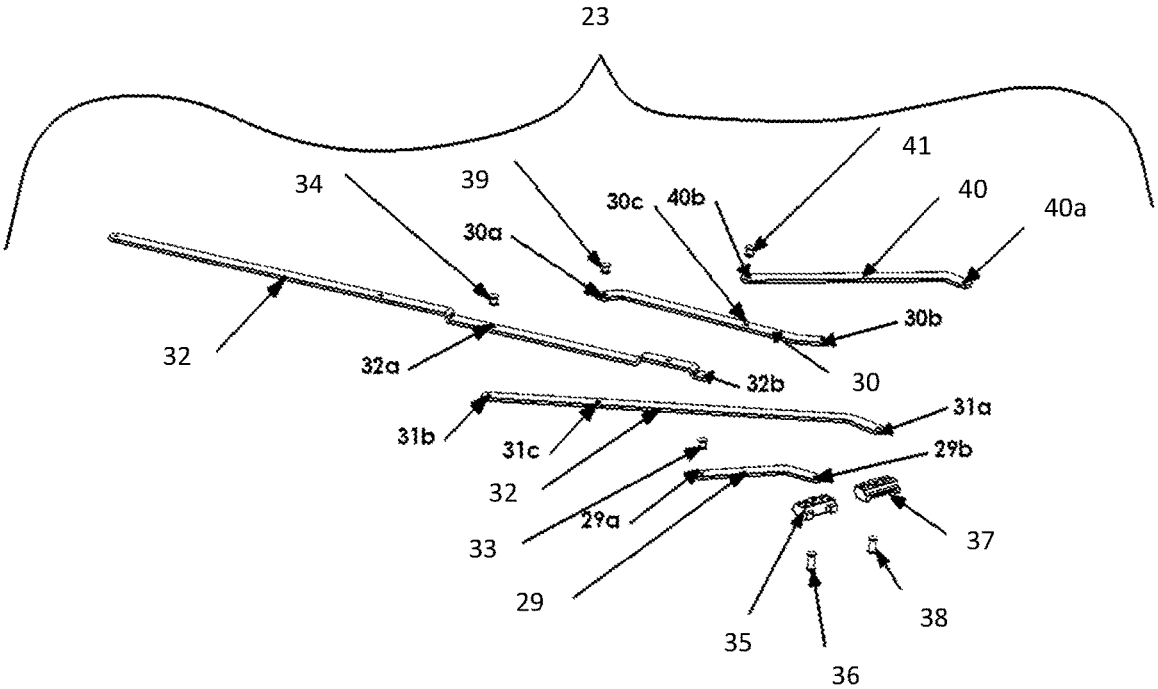
Figure 6:
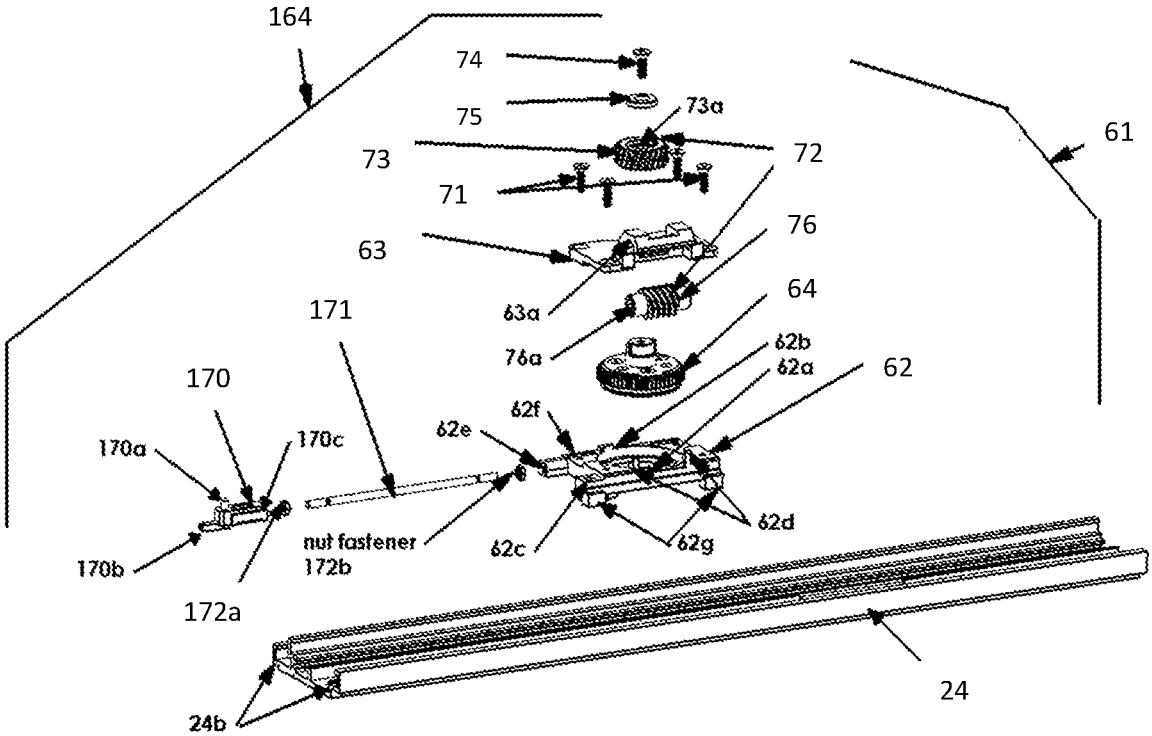
Figure 7A:
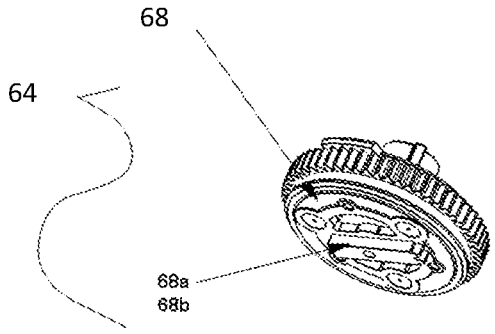
Figure 7B:
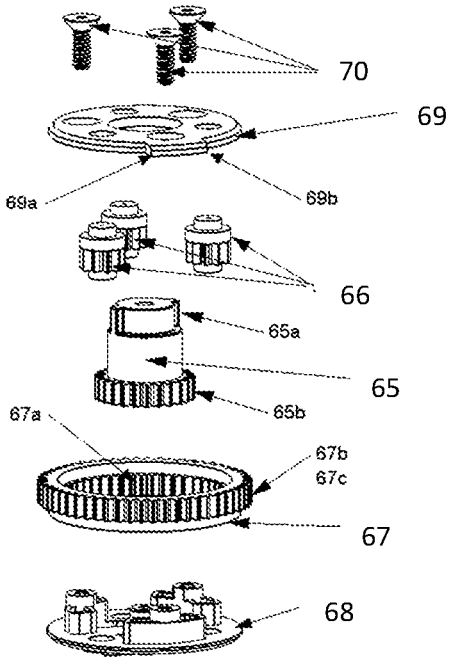
Figure 8A:
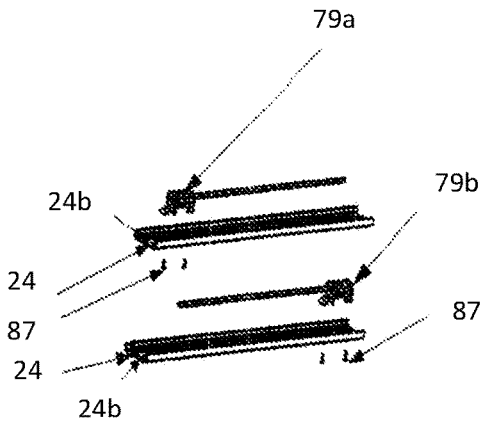
Figure 8B:
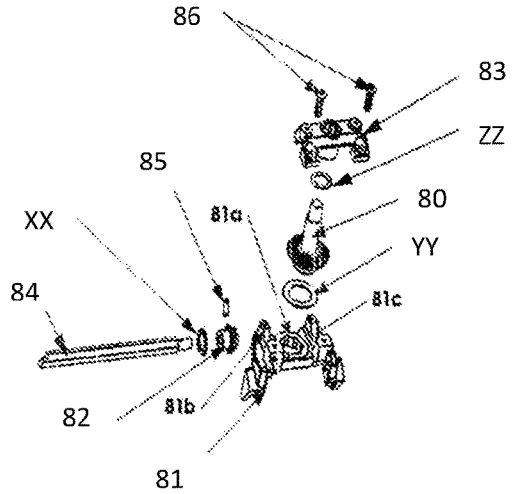
Figure 9B:
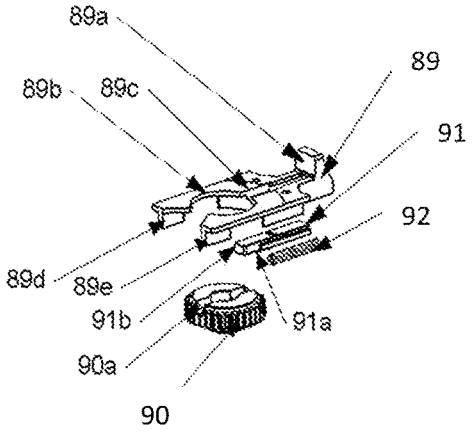
Figure 9A:
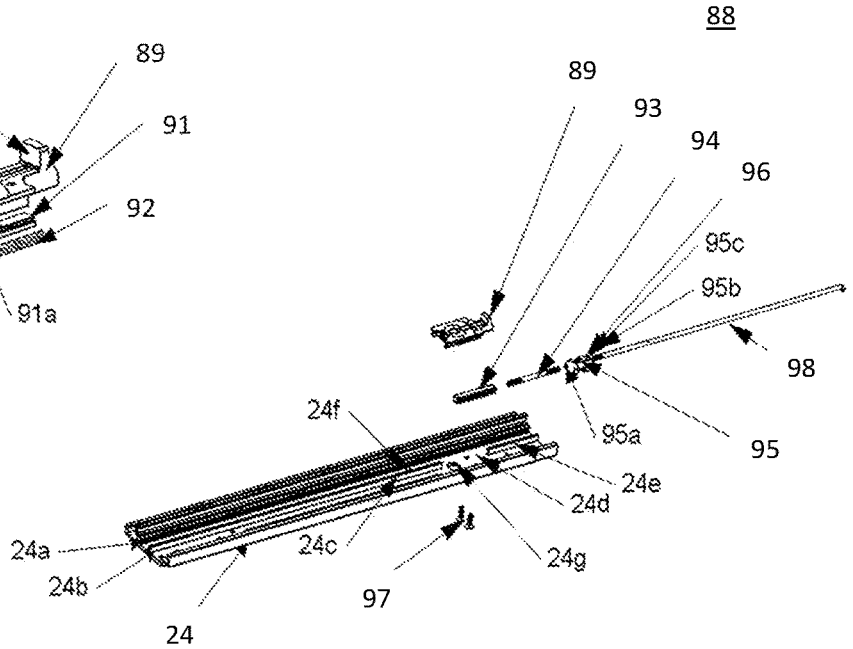
Figure 10A:
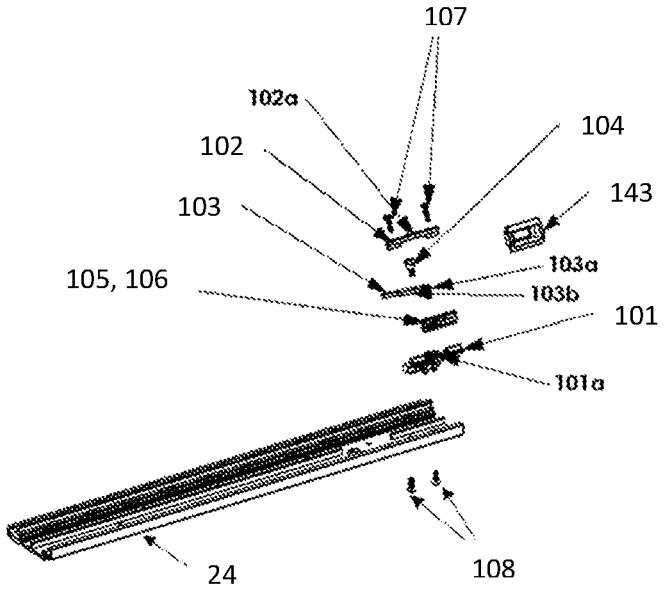
Figure 10B:
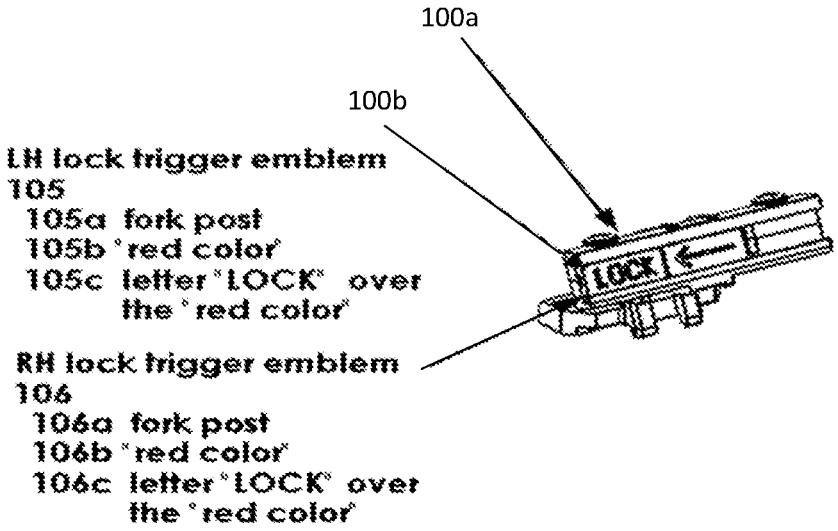
Figure 11A:
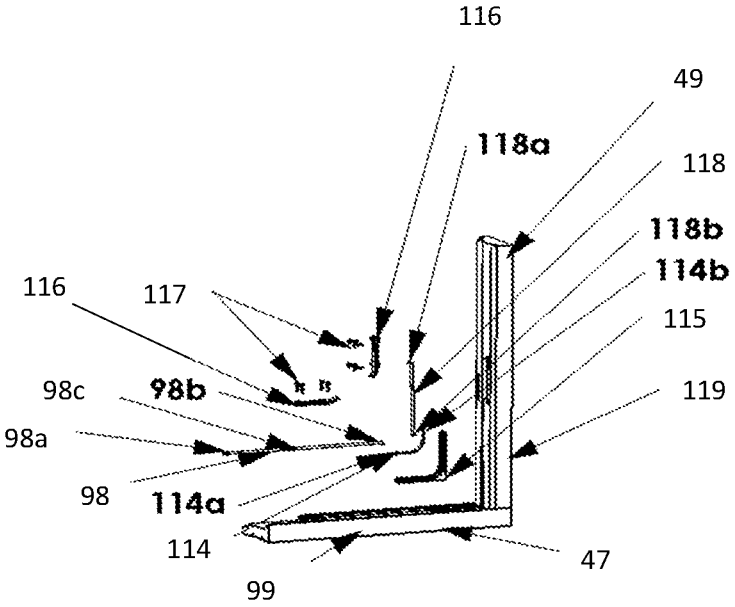
Figure 11B:
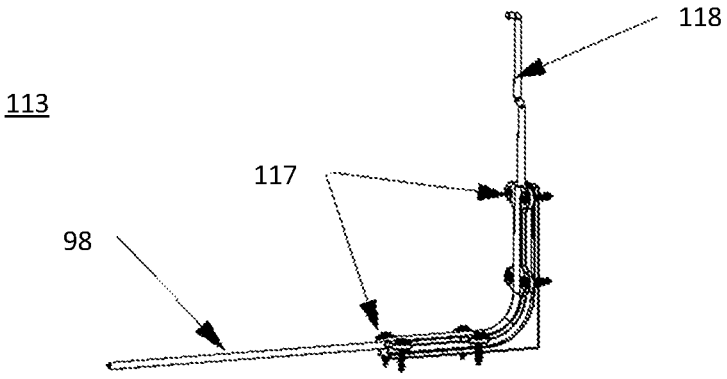
Figure 12C:
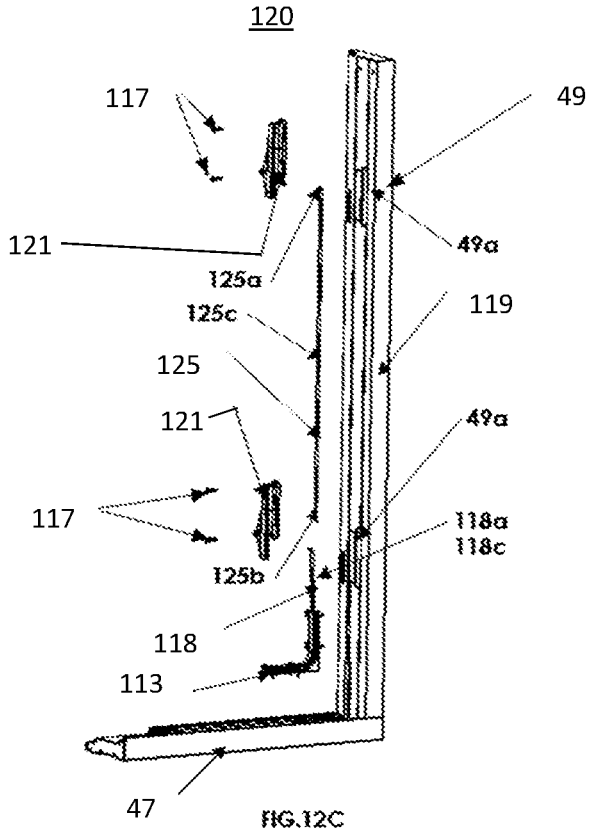
Figure 13A:
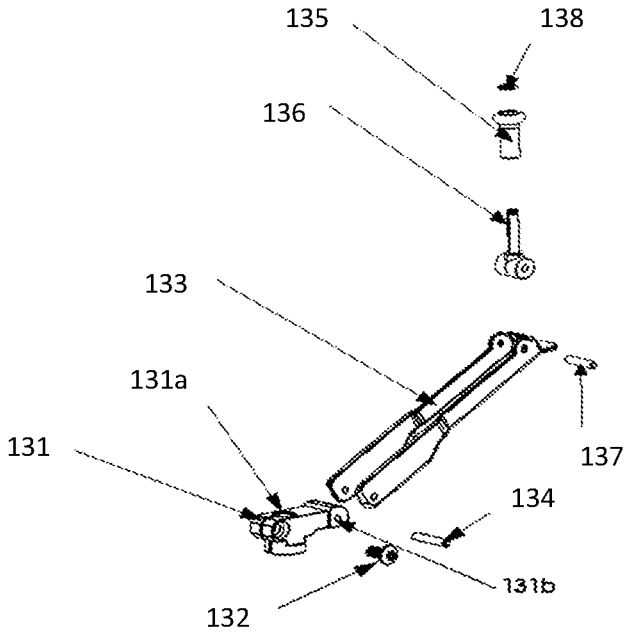
Figure 13B:
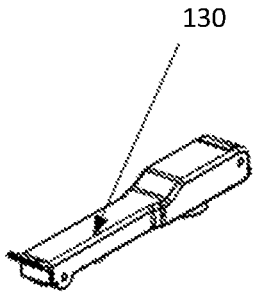
Figure 14:
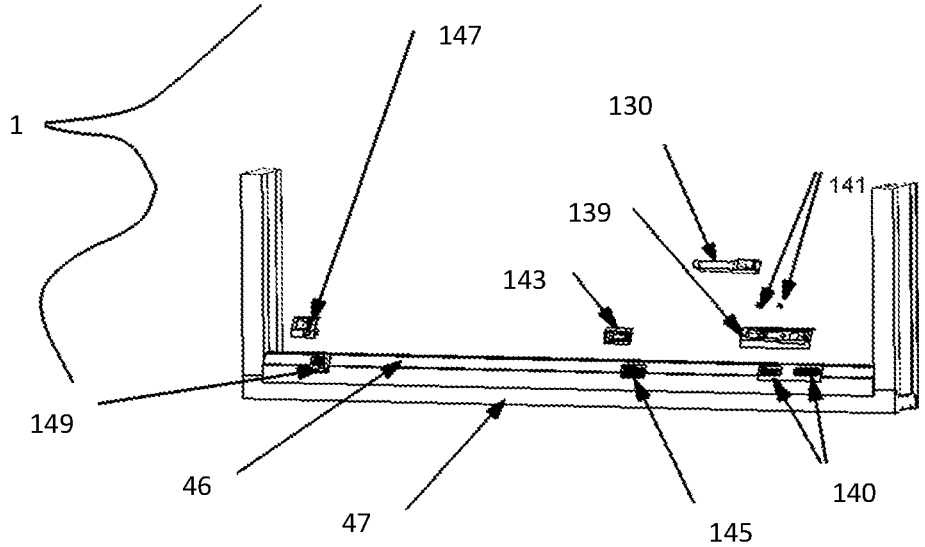
Figure 15A:
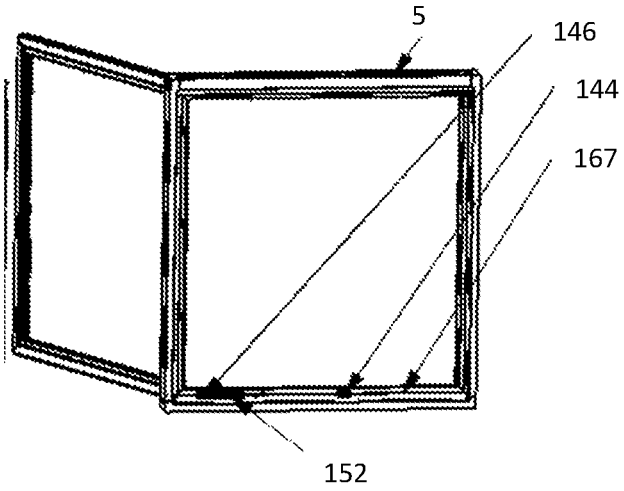
Figure 15B:
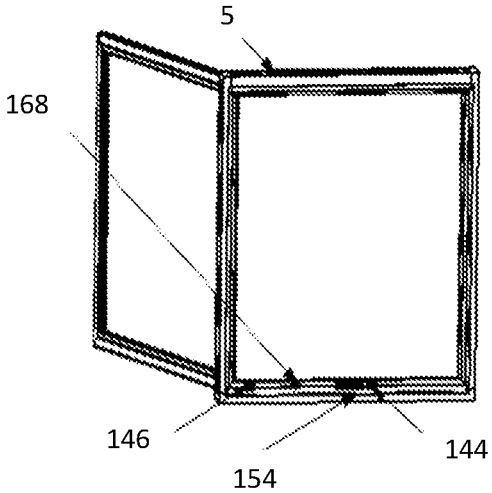
Figure 15C:
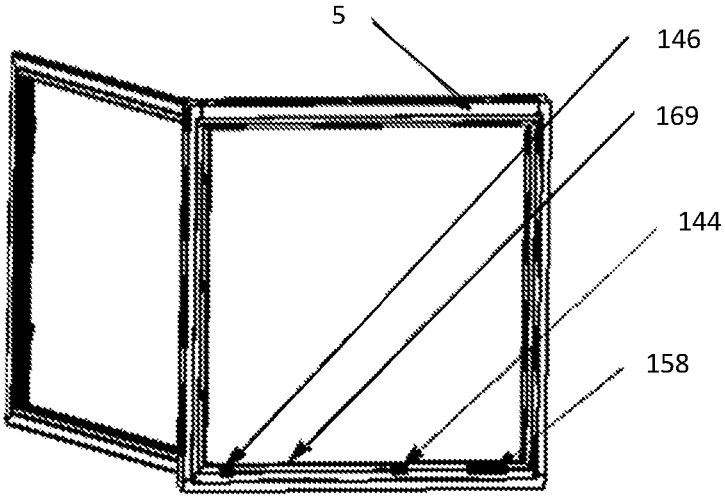
Figure 16A:
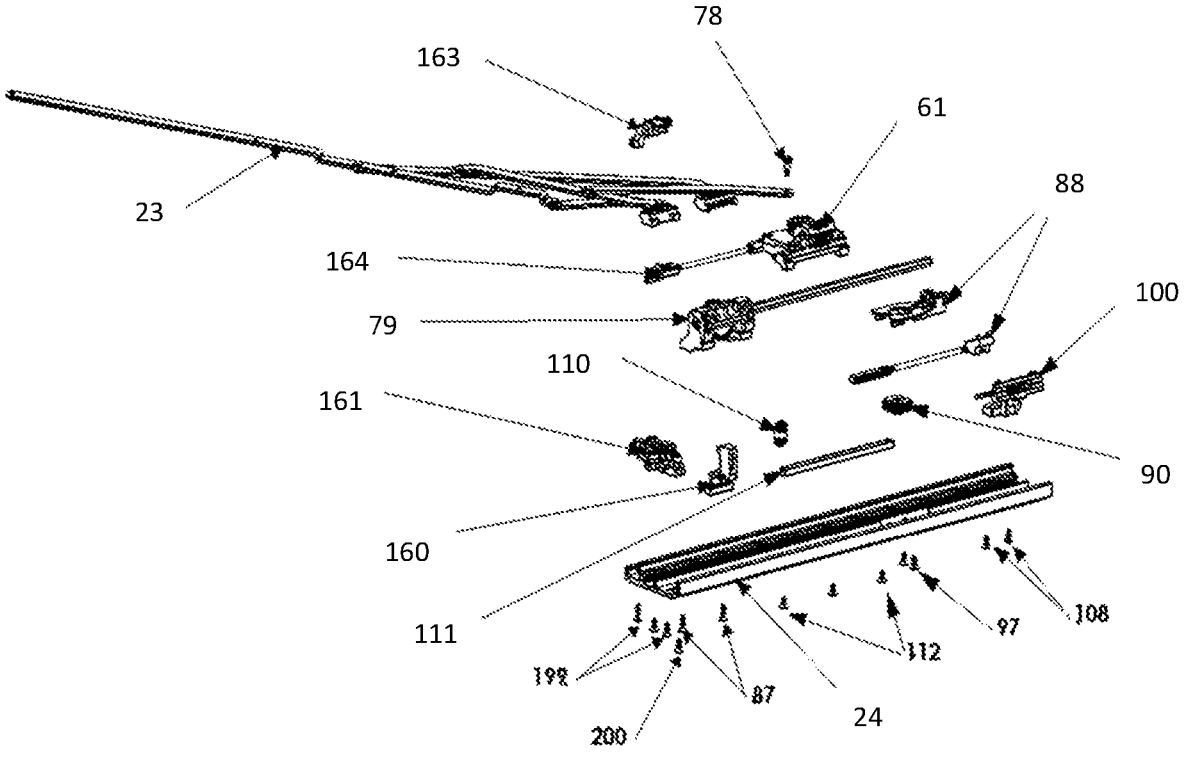
Figure 16B:
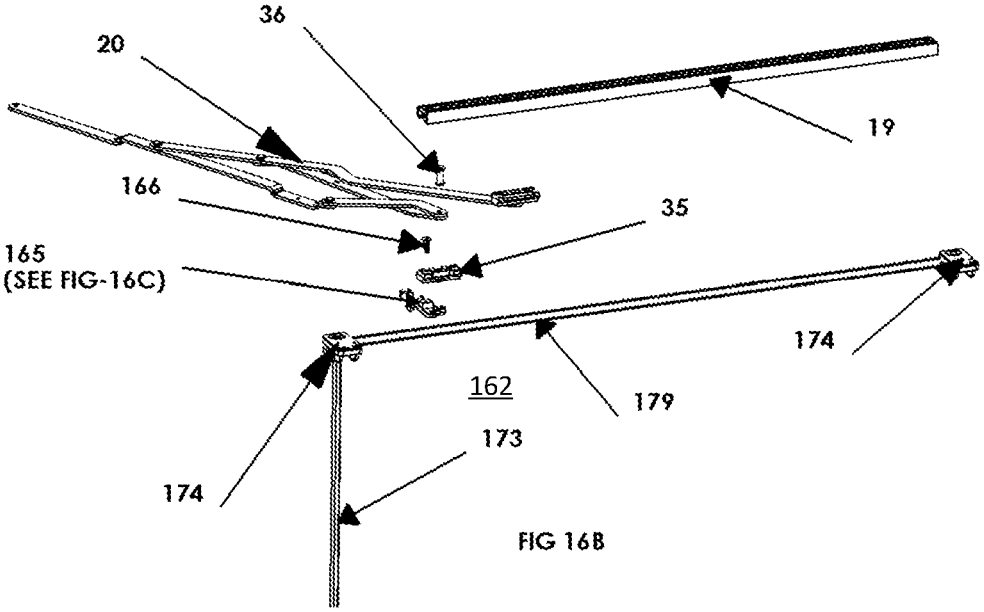
Figure 16C:
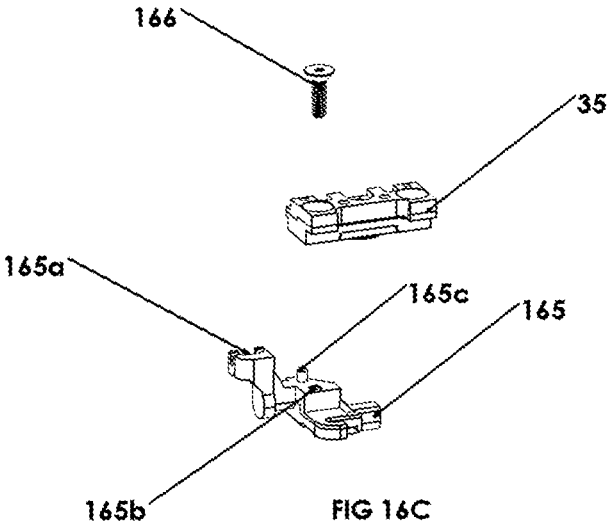
Figure 17A:
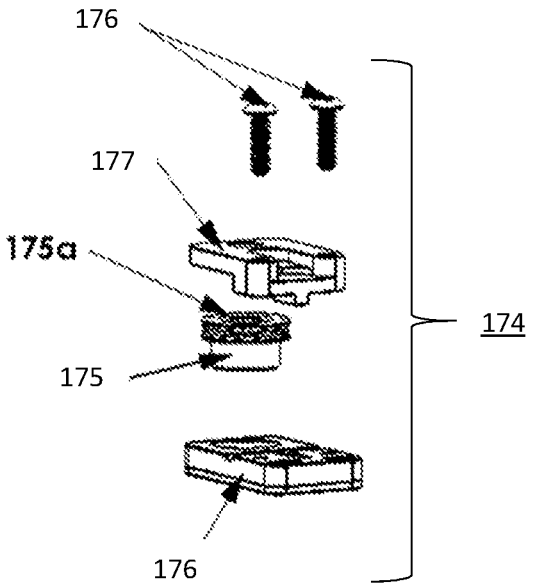
Figure 17B:
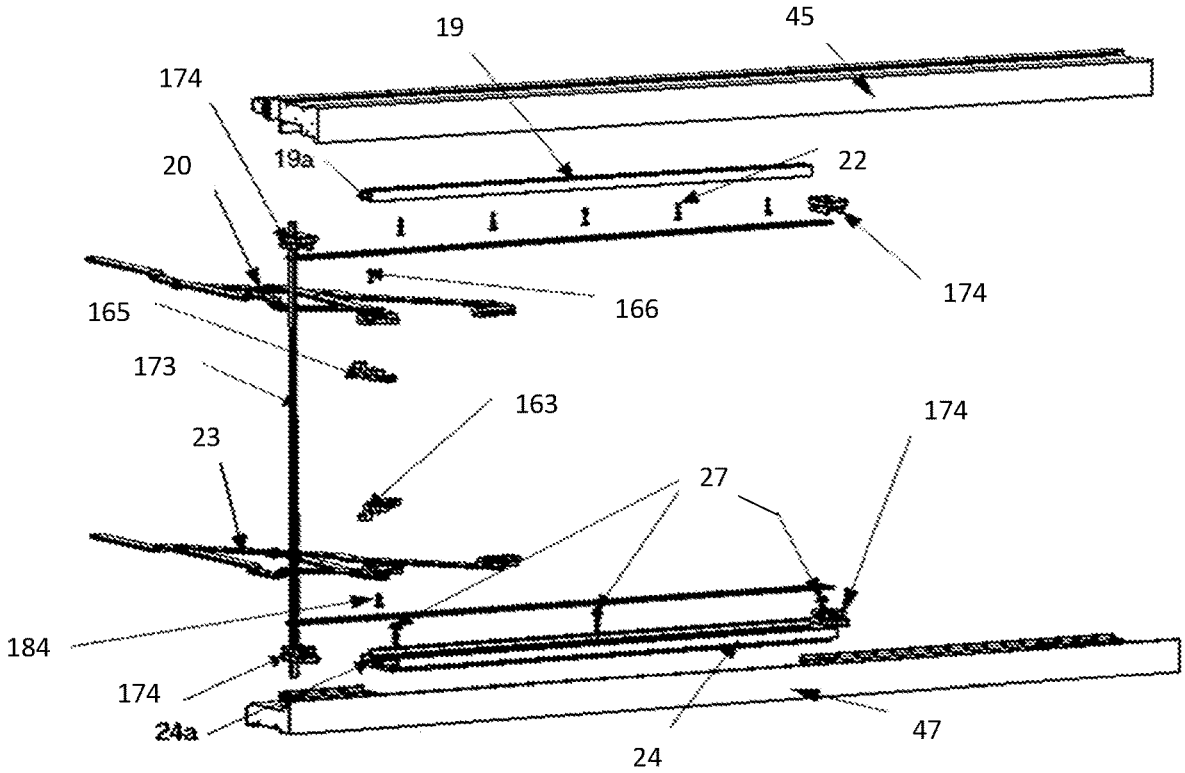
Figure 18A:
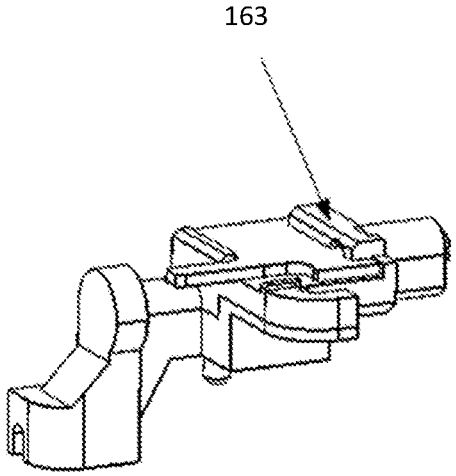
Figure 18B:
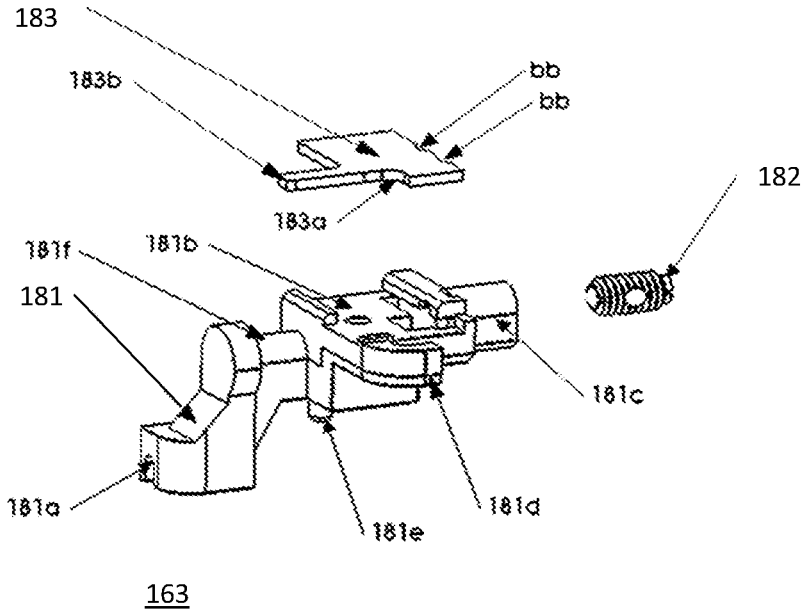
Figure 19A:
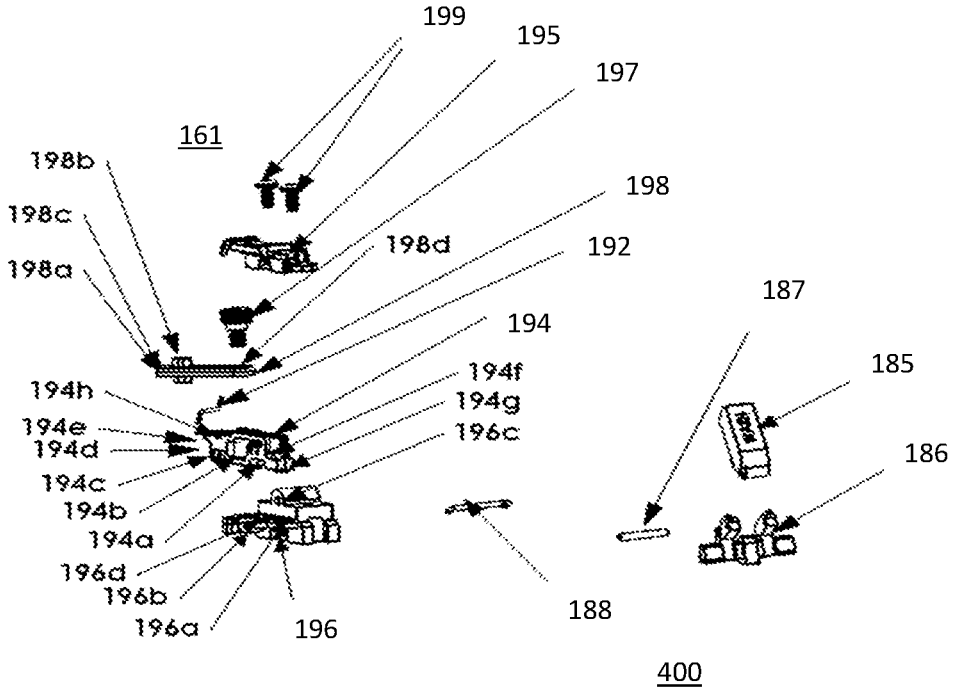
Figure 19B:
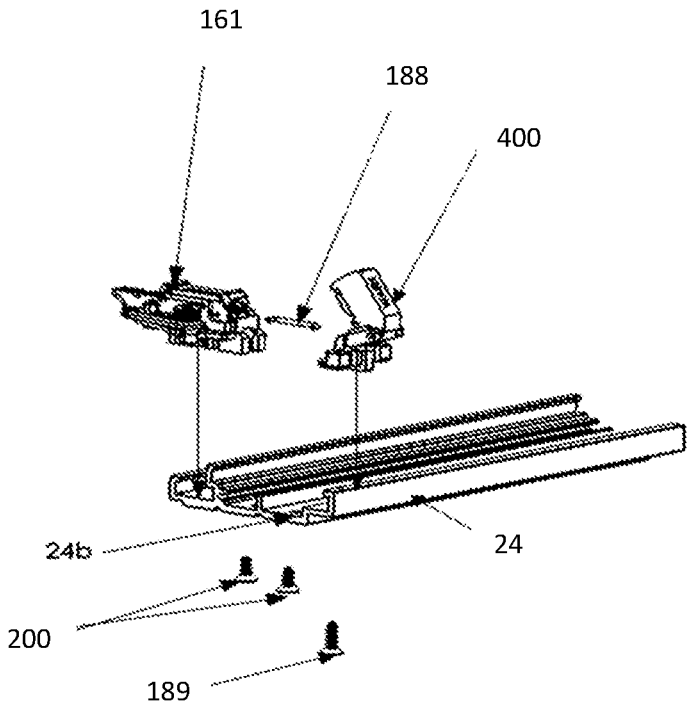
Figure 21:
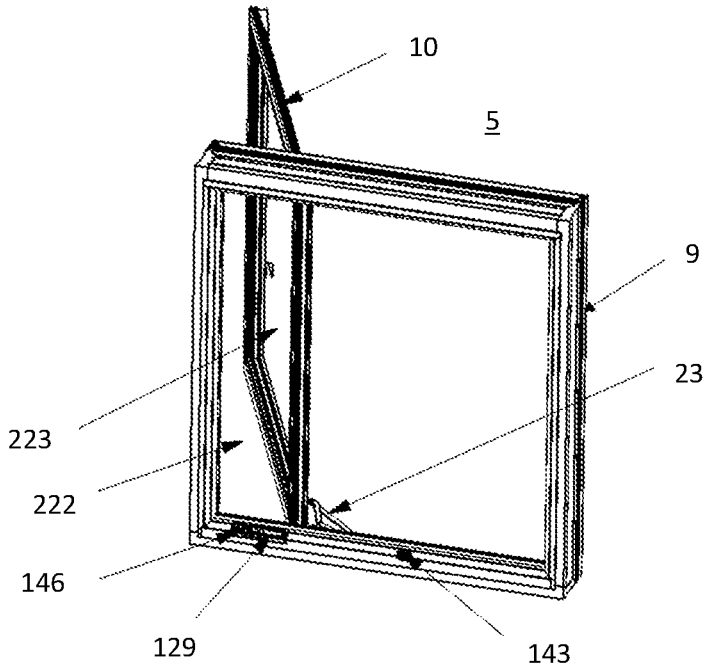

Having thus described examples of the disclosure in general terms, reference will now be made to the accompanying drawings, which are not necessarily drawn to scale, and wherein like reference characters designate the same or similar parts throughout the views. The particular objects and features of the instant disclosure as well as the advantages related hereto will become apparent from the following description taken in connection with the accompanying drawings, and wherein:

FIG. 1 is an illustration of a double window complete including a LH window complete and a RH window complete attached together according to an embodiment of the disclosure;

FIG. 2 is an illustration of a LH window complete having upper and lower platform units according to an embodiment of the disclosure;

FIG. 3A is an illustration of an upper link arm mechanism for a LH widow complete with a corresponding platform base in exploded view according to an embodiment of the disclosure;

FIG. 3B is an illustration of a lower link arm mechanism for a LH widow complete with a corresponding platform base in exploded view according to an embodiment of the disclosure;

FIG. 4 is an illustration of a LH window complete in exploded view according to an embodiment of the disclosure;

FIG. 5 is an illustration of a LH lower link arm mechanism in exploded view according to an embodiment of the disclosure;

FIG. 6 is an illustration of a LH sliding drive mechanism with wash mode attachment in exploded view according to an embodiment of the disclosure;

FIG. 7A is an illustration of an assembled planetary gear set according to an embodiment of the disclosure;

FIG. 7B is an illustration of the planetary gear set of FIG. 7A in exploded view according to an embodiment of the disclosure;

FIG. 8A is an illustration of a LH handle drive mechanism according to an embodiment of the disclosure;

FIG. 8B is an illustration of a RH handle drive mechanism according to an embodiment of the disclosure;

FIG. 9A is an illustration of a LH lockout mechanism in exploded view according to an embodiment of the disclosure;

FIG. 9B is an illustration of the LH lockout mechanism of FIG. 9A according to an embodiment of the disclosure;

FIG. 10A is an illustration of a lock trigger mechanism in exploded view according to an embodiment of the disclosure;

FIG. 10B is an illustration of the lock trigger mechanism of FIG. 10A in assembled view according to an embodiment of the disclosure;

FIG. 11A is an illustration of a corner strap mechanism of in exploded view according to an embodiment of the disclosure;

FIG. 11B is an illustration of the corner strap mechanism of FIG. 11A according to an embodiment of the disclosure;

FIG. 12A is an illustration of single latch of a multiple latching system in exploded view according to an embodiment of the disclosure;

FIG. 12B is an illustration of the single latch of the multiple latching system shown in FIG. 12A being mounted to a latch side frame section according to an embodiment of the disclosure;

FIG. 12C is an illustration of a multiple latching system including multiple latches of the kind shown in FIG. 12A according to an embodiment of the disclosure;

FIG. 13A is an illustration of a folding hand crank in exploded view according to an embodiment of the disclosure;

FIG. 13B is an illustration of the folding hand crank of FIG. 13A in an assembled view according to an embodiment of the disclosure;

FIG. 14 is an illustration of a wash mode window complete having multiple bezels according to an embodiment of the disclosure;

FIG. 15A is an illustration of a LH window complete having a LH hand crank according to an embodiment of the disclosure;

FIG. 15B is an illustration of a LH window complete having a centrally located hand crank according to an embodiment of the disclosure;

FIG. 15C is an illustration of a LH window complete having a RH hand crank according to an embodiment of the disclosure;

FIG. 16A is an illustration of a LH lower platform with a wash mode mechanism in exploded view according to an embodiment of the disclosure;

FIG. 16B is an illustration of a LH upper platform with a wash mode mechanism in exploded view according to an embodiment of the disclosure;

FIG. 16C is an illustration an upper cable block as part of the LH upper platform in exploded view according to an embodiment of the disclosure;

FIG. 17A is an illustration of a wash mode system added to a window complete in exploded view and according to an embodiment of the disclosure;

FIG. 17B is an illustration of the wash mode system added to the window complete of FIG. 17A in an assembled view according to an embodiment of the disclosure;

FIG. 18A is an illustration of an assembled LH lower cable block mechanism according to an embodiment of the disclosure;

FIG. 18B is an illustration of the LH lower cable block mechanism of FIG. 18A in exploded view according to an embodiment of the disclosure;

FIG. 19A is an illustration of a LH lever and lockout mechanism of a LH wash mode window complete according to an embodiment of the disclosure;

FIG. 19B is an illustration of the LH lever and lockout mechanism of the LH wash mode window complete of FIG. 19A according to an embodiment of the disclosure;

FIG. 20A, FIG. 20B, FIG. 20C, and FIG. 20D is a series of illustrations of a window complete in transition from an operational mode to a locking mode and back, and from operational mode to wash mode and back, according to an embodiment of the disclosure;

FIG. 21 is an illustration of a LH window complete at full open wash mode according to an embodiment of the disclosure.

DETAILED DESCRIPTION

The following description of the disclosed embodiments of this disclosure is intended to enable someone skilled in the prior art to make and use that which is disclosed, but is not intended to limit the claims to these particular exemplary embodiments.

Referring to the drawings in greater detail and by reference characters depicted therein, embodiments of this disclosure directed to operating hardware for a window complete are herein detailed. This operating hardware is configured and constructed to operate a window complete in three (3) modes of operations—an operational mode 2, a locking mode 3, and a wash mode 4. Each of these modes will be discussed further in relation to FIG. 20A, FIG. 20B, FIG. 20C, and FIG. 20D. In various embodiments, a window complete may be left hand (LH) window complete or a right hand (RH) window complete.

As illustrated in FIG. 1, a double window complete 15 is made by attaching a LH window complete 5 to a RH window complete 6. In various embodiments, the LH window complete may be a LH wash-mode window complete and/or the RH window complete may be a RH wash-mode window complete. In other embodiments of the disclosure, double window complete 15 may be a double wash-mode window complete.

Each of LH window complete 5 and RH window complete 6 includes a window frame 9 and a window sash 10. As shown, LH window complete 5 is configured with mounting hardware allowing its window sash to make a LH swing 11; and similarly, RH window complete 6 is configured with mounting hardware allowing its window sash to make a RH swing 12. Double window complete 15 is further configured with a double window trim set 17 and a double window center cap 18.

Referring now to FIG. 2, a window complete such as LH window complete 5 may have a window frame 9 that attaches to window sash 10 via mounting hardware including upper platform unit 13 and lower platform unit 14. Upper platform unit 13 attaches to window sash 10 using fasteners 21; and the upper platform unit additionally attaches and secures to window frame 9 using fasteners 22. Similarly, lower platform unit 14 attaches to window sash 10 using fasteners 22. Lower platform unit 14 further attaches and secures to window frame 9 using fasteners 27.

As shown in FIG. 2, LH window complete 5 may further include an upper frame cover 44 and a lower frame cover 46. In various embodiments of the disclosure, the upper frame cover 44 may be attached to an upper frame section which may include a platform groove detail (not shown) for aligning and mounting an upper platform base of the upper platform unit. In yet other embodiments of the disclosure, the lower frame cover 46 may be attached to a lower frame section which may include a platform groove detail (not shown) for aligning and mounting a lower platform base of the lower platform unit.

FIG. 2 further illustrates a folding hand crank 130 and latch hook 127 attached to the LH window complete. Various embodiments of the folding hand crank 130 will be detailed further in reference to FIG. 15, and latch hook 127 will be further described in reference to FIG. 13 which illustrates a multiple latching system.

In some embodiments, the upper platform unit 13 of FIG. 2 is comprised of an upper platform base 19, illustrated in FIG. 3A. As depicted, upper platform base 19 is constructed with a shoe guide track detail 19*a*, and configured to mount and attach an upper link arm mechanism 20 with fasteners 21 to the window sash 10. Additionally, the upper platform base 19 is attached and secured to the window frame 9 with fasteners 22.

As shown in FIG. 3B, the lower platform unit 14 is comprised of a lower link arm mechanism 23 and a lower platform base 24. As further detailed in regards to FIG. 9A, lower platform base may 24 be constructed with a shoe guide track detail 24*a*, a wider guide track 24*b* detail, a partially constructed guide rail 24*c* detail, a partial opening in guide rail 24*d* detail, a mounting guide track 24*e* detail, a stop pin hole 24*f* detail, and a gear aperture 24*g* detail (all of which are not shown in FIG. 3B).

FIG. 3B further shows a stop pin 25 which is attached to a stop pin hole (not shown) and mounting fasteners 26 configured to attach the lower link arm mechanism 23 to the window sash 10. Additionally, lower platform unit 14 is configured to attach and secure to the window frame 9 with fastener 27. FIG. 3B further illustrates push link 40 which is be discussed in detail regarding FIG. 5.

Referring now to FIG. 4, various embodiments of this disclosure include a window complete such as LH window complete 5 having an upper frame cover 44, attached to an upper frame section 45 of window frame 9; and upper frame section 45 may include a platform groove detail (not shown) for aligning and mounting the upper platform base. FIG. 4 further illustrates a lower frame cover 46, attached to a lower frame section 47 of the frame, which is so constructed in some embodiments, with a platform groove detail (not shown) for aligning and mounting the lower platform base. Additionally, a latch side frame cover 48, attached to a latch side frame section 49 so constructed with a latch mounting slot detail 49*a* (shown in FIG. 12B regarding a multiple latching system); and a hinge side frame cover 50, attached to hinge side frame section 51. As shown, the LH window complete is further configured with a window sash seal set 52, a window trim set 53, and a window exterior cap set 54.

As illustrated in FIG. 4, the window sash 10 further comprises a sash exterior cap set 55, a sash glass 56 (which may be constructed as single, double, or triple panes of glass), a sash hinge side piece 57, a sash latch side piece 58, so constructed with a latch hook slot detail (not shown), a sash upper top piece 59, so constructed with a mounting slot detail 59*a* (shown in FIG. 12A regarding a multiple latching system), for mounting the upper link arm mechanism, a sash lower bottom piece 60 so constructed with a mounting slot 60*a* detail, for mounting the lower link arm mechanism.

FIG. 4 further references a multiple latching system 120 detailed further in regards to FIG. 12A, FIG. 12B, and FIG. 12C, corner strap mechanism 113 detailed further in regards to FIG. 11A and FIG. 11B, indicator output rod 98 detailed further in regards to FIG. 9B, and hex shaft 173 and four (4) sprocket mechanism 174 as further detailed in regards to FIG. 17A and FIG. 17B.

FIG. 5 illustrates an exploded view of a lower link arm mechanism 23 as shown in FIG. 3B. Various embodiments of the disclosure teach that the upper link arm mechanism 20 (shown in FIG. 3B) and lower link arm mechanism 23 each include a 4-bar scissor linkage 28 with four (4) named links. The 4-bar scissor linkage 28 includes: a hinge link 29 which is constructed with two (2) holes 29*a* and 29*b*; a cross link 30, constructed with three (3) holes 30*a*, 30*b*, and 30*c*; an outboard link 31, constructed with three (3) holes 31*a*, 31*b*, and 31*c*; and a sash link 32, constructed with two (2) holes 32*a* and 32*b* and attachment holes 32*c* for mounting to the window sash and mounting to hole 29*a* of said hinge link with rivet 33. 8As further shown, a fixed-slider shoe 35 attaches to hinge link 29 via hole 29*b* using long rivet 36 and the fixed-slider shoe 35 further attaches to cross link 30 via hole 30*b*. Additionally, a slider shoe 37 attaches to hole 31*a* of the outboard link 31 using a medium rivet 38. A rivet 39 is used to attach cross link 29 to outboard link 31 via holes 29*a* and 31*c*. Rivet 34 connects link 32 to link 31.

Further illustrated in FIG. 5, on the lower link arm mechanism 23 only, the addition of a push link 40, constructed with two holes, hole 40*a* and hole 40*b*, is attached to cross link 30 via hole 30*c* using rivet 41.

Referring to FIG. 6, a wash mode sliding drive mechanism which is generally denoted as reference number 164 includes sliding drive mechanism 61 which attaches to the wider guide track 24*b* of the lower platform base 24, in addition to a trigger block 170. Sliding drive mechanism 61 may be a L.H. sliding drive mechanism or as a R.H. sliding drive mechanism, and the sliding drive mechanism 61 includes a sliding housing base 62, constructed with rotational beginning stop block 62*a* and rotational end stop block 62*b*, a threaded c'bore 62*c*, a half circle 62*d*, a threaded aperture 62*e*, an end stop 62*f* detail, and sliding block 62*g*. As shown, the sliding drive mechanism 61 further includes a sliding housing top piece 63, constructed with a half circle 63*a* detail; and a planetary gear set 64 which is further detailed in reference to FIG. 7A and FIG. 7B, and which is captured between the sliding housing top piece 63 and the sliding housing base 62 using fasteners 71.

Further, FIG. 6 illustrates a worm and wheel gear set 72 includes a wheel gear 73, so constructed with a double key 73*a* detail, mounted to and secured to the planetary gear set 64 with fastener 74 and washer 75. The worm and wheel gear set 72 additionally includes worm gear 76, constructed with a hex aperture 76*a* detail. As shown, worm gear 76 is captured within the half circle of both the sliding housing top piece 63*a* and sliding housing base 62*d*, and is coupled to the wheel gear 73, when the sliding housing top piece 63 is secure to the sliding housing base 62, with fasteners 77.

Furthermore, according to various embodiments of the disclosure with a wash mode sliding drive mechanism 164 and as illustrated by FIG. 6, the sliding drive mechanism 61 is mounted such that it can freely slide within the wider guide track 24*b* within the lower platform base 24. Moreover, hole 40*b* of the push link 40 of lower link arm mechanism 23 is attached to the threaded c'bore hole 62*c* detail of the sliding housing base 62 using a shoulder bolt fastener (not shown).

As shown in FIG. 6, trigger block 170 is further constructed with a trigger post 170*a* detail, a trigger paw 170*b* detail, and a threaded end 170*c* detail. Additionally, trigger block 170 attaches to a threaded trigger rod 171 via a nut fastener 172*a*. Nut fastener 172*b* further attaches the threaded trigger rod 171 to the sliding housing base 62, such that the wash mode sliding drive mechanism 164 is mounted and captured within the wider guide track 24*b* of the lower platform base 24.

Referring to FIG. 7A, a planetary gear set 64 is illustrated in assembled form, showing the planetary base 68 and the interlock key 68*a* and base output gear 68*b* disposed on a bottom side of the planetary base.

FIG. 7B further illustrates the parts of the disclosed planetary gear set in an exploded view. As shown, planetary gear set 64 includes a sun gear 65, so constructed with an input drive key 65*a* and an input gear 65*b* detail. The planetary gear set further includes three (3) planet gear 66 and a ring gear 67, the ring gear having an inner ring gear teeth 67*a* detail, an outer ring gear teeth 67*b* detail, and further defined as outer ring output gear 67*c*, in addition to the planetary base 68. Further, the planetary gear set includes a planetary cap 69, so constructed with rotational beginning stop 69*a* detail and rotational end stop 69*b* detail. As illustrated, the planetary gear set 64 is secured between the planetary cap 69 and the planetary base 68 together with fasteners 70.

FIG. 8A illustrates a LH handle drive mechanism 79*a* in exploded view and as mounted on a lower platform base 24, and FIG. 8B illustrates a RH handle drive mechanism 79*b* in a semi-assembled state. A handle drive mechanism according to the disclosure may be configured as a LH handle drive mechanism 79*a* or a RH handle drive mechanism 79*b*. As shown, each of LH handle drive mechanism 79*a* and RH handle drive mechanism 79*b* includes a respective input bevel gear 80 having an input shaft 80*a* and a handle keyway 80*b*, although for purposes of clarity and distinction, only these two latter features are shown in an exploded view in FIG. 8A in relation to LH handle drive mechanism 79*a* and not in the semi-assembled state of RH handle drive mechanism 79*b* in FIG. 8B.

Additionally, each handle drive mechanism has a respective handle drive base 81, an output drive gear 82, a handle drive cap 83, and a handle drive shaft 84. As shown, the handle drive cap 83 of each of the LH handle drive mechanism 79*a* and the RH handle drive mechanism 79*b* includes a hole 83*b* for receiving the respective input bevel gear 80 and a half hole 83*a*. FIG. 8B illustrates the handle drive base 81 and output drive gear 82 of RH handle drive mechanism 79*b* as already mounted to and secured onto the respective handle drive shaft 84. In contrast, the handle drive base 81 of the LH handle drive mechanism 79*a* is illustrated in an exploded view in FIG. 8A in order to show the additional features, for example, the handle drive base 81 including a bearing hole 81*a* for receiving the input bevel gear 81, and a half hole 81*b* for mounting an output drive gear 82 with a aperture 82*a*. The output drive gear 82 mounts or secures onto the handle drive shaft 84 using clip fasteners 85*a* and 85*b*, and the output drive gear is captured within the half hole 81*b* of the handle drive base 81 and the half hole 83*a* of the handle drive cap 83 with fasteners 86. In some embodiments, the handle drive shaft 84 has retainer grooves on it to help secure the output drive gear 82 thereto.

In some embodiments, the output drive gear is an output hex drive gear, and the handle drive shaft is a handle hex drive shaft. However, the handle drive shaft can have a square or a "D" shape, or any shape that has at least one flat side to transmit torque from the crank handle to the drive system. The output drive gear can have whatever shape as that of the corresponding handle drive shaft.

Further, the handle drive mechanism, is mounted and secured to the wider guide track 24*b* of the lower platform unit 24 via fastener 87.

Referring now to FIG. 9A and FIG. 9B, operating hardware of the disclosure may further include a lockout mechanism 88. FIG. 9A is an exploded view of a lockout mechanism 88 with an indicator block 95 and indicator output rod 98. As shown, lockout mechanism 88 includes a lockout base 89, constructed with a two (2) threaded block 89*a* feature in which one of the two threaded block 89*a* is assigned for a LH lockout base 89*b*, and another of the two threaded block 89*a* is assigned for a RH lockout base 89*c*. Lockout base 89 further includes a hole 89*d*, a locking bar slot 89*e*, and a rack guide feature 89*f* and 89*g*, wherein rack guide 89*g* is assigned for the LH lockout base 89*b* and the other rack guide 89*f* is assigned for a RH lockout base. Lockout mechanism 88 further includes a slotted pinion gear 90 having a key slot 90*a*, a locking bar 91 having a spring tab 91*a*, a compression spring 92, a short drive rack 93 with a threaded end (not shown) that couples to the slotted pinion gear 90, and attaches and mounts to a rack rod 94 with threaded ends 94*a* and 94*b*.

FIG. 9A further depicts lockout mechanism 88 as including an indicator block 95 having a threaded in-port 95*a*, a threaded out-port 95*b*, and a two (2) pin hole 95*c*. The lockout mechanism further includes a pair of roll pin fasteners 96 attached to the indicator block 95. As shown in FIG. 9A, the lockout mechanism 88 is subsequently mounted and secured to the lower platform base 24 with fasteners 97.

Further, FIG. 9A provides a detailed illustration of lower platform base 24, with references to the various parts thereof. As shown, lower platform base 24 may be constructed with a shoe guide track 24*a*, a wider guide track 24*b*, a partially constructed guide rail 24*c*, a partial opening in guide rail 24*d*, a mounting guide track 24*e*, a stop pin hole 24*f*, and a gear aperture 24*g*.

FIG. 9B illustrates the lockout mechanism of FIG. 9A in an assembled state prior to mounting to the lower platform base.

Referring now to FIG. 10A and FIG. 10B, embodiments of the disclosure include an operating hardware having a lock trigger mechanism which may be a LH trigger mechanism 100*a* or a RH trigger mechanism 100*b*. FIG. 10 illustrates a LH trigger mechanism 100*a* including a lock trigger base 101 having clip notch 101*a*, a lock trigger cap 102 having a clip notch 102*a*, a lock trigger lever 103 having a fork 103*a* on one end, and a finger 103*b* feature on the other end. As shown, lock trigger lever 103 is mounted to lock trigger base 101 with a shoulder bolt fastener 104. Additionally, the LH trigger mechanism includes a LH lock trigger emblem 105 which includes a fork post 105*a* feature, a "Red" color 105*b*, and letters "LOCK" 105*c* printed over the "Red" color and placed on the left side of the LH lock trigger emblem, and a "Green" color 105*d* placed on the right side of the LH lock trigger emblem.

As shown in FIG. 10B, a RH trigger mechanism 100*b* includes all the individual features 101 thru 104 referenced in regards to LH trigger mechanism 100*a* shown in FIG. 10A and these are illustrated in assembled form in FIG. 10B. FIG. 10B also shows RH trigger mechanism 100*b* having a RH lock trigger emblem 106. As shown, RH lock trigger emblem 106 includes a fork post 106*a* feature, a "Red" color 106*b*, and with letters "LOCK" 106*c* printed over the "Red" color and placed on the right side of the RH lock trigger emblem, and a "Green" color 106*d* placed on the left side of the RH lock trigger emblem.

Further, the LH lock trigger emblem of FIG. 10A and the RH lock trigger emblem of FIG. 10B each are captured and secured between the respective lock trigger cap 102 and lock trigger base 101 with fasteners 107. Moreover, as shown on FIG. 10A relating to LH trigger mechanism 100*a*, the lock trigger mechanism, is mounted and secured to lower platform base 24 with fasteners 108.

Referring now to FIG. 11A and FIG. 11B, embodiments of the disclosure include a window complete operating hardware having a corner strap mechanism 113. As shown in FIG. 11A illustrating a corner strap mechanism 113 in an exploded view, corner strap mechanism 113 includes a flexible metal strap 114 having a horizontal input hole 114*a* and a vertical output hole 114*b*, a corner base piece 115, and a corner cap piece 116 with a mounting tab (not shown). The corner cap piece 116 is mounted and secured to both, the lower frame section 47, and the latch side frame section 49, with fasteners 117. The flexible metal strap 114 is secured between the corner base piece 115 and the corner cap pc 116. FIG. 11A further illustrates an indicator output rod 98 attached to the horizontal input hole 114*a*; and on the opposite end, indicator output rod 98 is attached to a threaded out-port of an indicator block (not shown). Indicator output rod 98 includes threaded end 98*a*, a hook end 98*b*, and is so configured with different lengths 98*c*, such that the lengths are determined by different window width sizes 99.

Further, the corner strap mechanism 113 of FIG. 11A includes a corner output rod 118 having two hook ends 118*a* and 118*b* attached to the vertical output hole of the flexible metal strap prior to final assembly of the corner cap piece to the corner base piece. The corner output rod is configured with different lengths 118*a* which are determined by different window height sizes 119.

Referring now to FIG. 12A, FIG. 12B, and FIG. 12C according to various embodiments of the disclosure, an operating hardware for a window complete further includes a multiple latching system. The multiple latching system, generally denoted as reference number 120, includes several sliding latch mechanism 121 depending on the window height size 119, as shown in FIG. 12C.

FIG. 12A illustrates an exploded side view of a single sliding latch mechanism along with a sash upper top piece 59 to which the sliding latch mechanism is mounted. FIG. 12B illustrates a semi-assembled side view of a sliding latch mechanism in FIG. 12A along with a latch side frame section 49 upon which the sliding latch mechanism is mounted. As shown, each sliding latch mechanism 121 includes a latch plate 122 having input and output rod holes 122*a* and 122*b*, a latch mount base 123, and a roller fastener set 124 which includes a latch roller 124*a*, and a nut and bolt fastener 124*b*, 124*c*.

When more than one sliding latch mechanism is required, to complete the multiple latching system, a latch to latch rod 125 is made at rod hook ends 125*a* and 125*b* and has a latch rod length 125*c* that is determined by the different window height sizes 119. Additionally, a latch to corner output rod 118 is made at rod hook end 118*a* which has opposite rod end 118*b* attached to the corner strap mechanism 113. Corner output rod 118 has a latch rod length 118*c* that is determined by the different window height sizes 119.

Further illustrated in FIG. 12A, as a match set 126 to each of the sliding latch mechanism, is a latch hook 127 mounted to the mounting slot 59*a* of the window sash using fasteners 128 via a tapper lead-in 127*a* on the latch hook. The sliding match mechanism 121 is further mounted with fasteners 117 to latch side frame section 49 at a latch mounting slot 49*a* as illustrated in FIG. 12B.

FIG. 12C, illustrating the semi-assembled side view of the multiple latching system, depicts several sliding latch mechanism as they attach to latch side frame section 49 and also how the sliding latch mechanism are positioned in regards to lower frame section 47. In particular, the corner strap mechanism 113 is shown positioned as it will mount to lower frame section 47 and latch side frame section 49. Corner output rod 118 is positioned between the portion of the corner strap mechanism attached to the latch side frame section and a first of several sliding latch mechanism.

Operating hardware for a window complete according to various embodiments of the disclosure include a hand crank 129 mounted to a lower frame section, as will be detailed further in relation to FIG. 21. Referring to FIGS. 13A and 13B, a hand crank of this disclosure may be a folding hand crank 130. FIG. 13A, illustrating an exploded view of a folding hand crank according to an embodiment of the disclosure, shows that folding hand crank 130 includes a hub 131 constructed with a handle mount bore 131*a* and a pin aperture 131*b*, which mounts to the input shaft of a handle drive mechanism (not shown) with a fastener 132. The folding hand crank further includes a handle 133 which mounts to the hub with a handle pin 134; a nob 135; nob hub 136 which mounts to the handle with a nob pin 137; and a clip fastener 138. FIG. 13B shows an assembled view of the folding hand crank of FIG. 13A.

Referring now to FIG. 14, in an embodiment of the disclosure, the window complete 1 includes a handle crank bezel 139, a lock trigger bezel 143, and a wash mode bezel 147. As shown, handle crank bezel 139 mounts and secures to lower frame cover 46 with fasteners 141 through an aperture 140 in the lower frame cover. Similarly, the lock trigger bezel 143 mounts and secures to the lower frame cover through an aperture 145 in the lower frame cover; and wash mode bezel 147 mounts and secures to the lower frame cover through an aperture 149 in the lower frame cover. While not shown in FIG. 14, the lock trigger bezel 143 is part of a lock trigger bezel mechanism (shown in FIG. 15A, FIG. 15B, and FIG. 15C as reference number 144) along with a pair of mounting clips (not shown); and the wash mode bezel 147 is part of a wash mode bezel mechanism (shown in FIG. 15A, FIG. 15B, and FIG. 15C as reference number 146) along with a pair of mounting clips (not shown).

Referring now to FIG. 15A, FIG. 15B, and FIG. 15C, embodiments of the disclosure are directed to operating hardware for a window complete which include several possible locations for the hand crank within the lower frame cover of the window frame. For ease of reference, each of FIG. 15A, FIG. 15B, and FIG. 15C illustrate a LH window complete 5, but it should be understood that the same hand crank locations are possible for RH window complete embodiments as well. FIG. 15A illustrates a LH window complete with a handle drive mechanism mounted and secured at LH location 152, wherein the handle drive mechanism is mounted to the lower platform unit for the hand crank to be located near the hinge side frame section. FIG. 15B illustrates a LH window complete with a center hand crank location 154, wherein a handle drive mechanism is mounted to the lower platform unit for the hand crank to be located near the center of the window frame. FIG. 15C illustrates a LH window complete with a handle drive mechanism mounted and secured at RH location 158, wherein the handle drive mechanism is mounted to the lower platform unit for the hand crank to be located near the latch side frame section.

Further, if the window complete is a LH wash-mode window complete or a RH wash-mode window complete, the embodiment shown in FIG. 15A would also include a lower frame wash mode cover-LH handle 167. Similarly, if the LH window complete shown in FIG. 15B is a LH wash-mode window complete, the embodiment would further include a lower frame wash mode cover-center handle 168. Accordingly, if the LH window complete shown in FIG. 15C is a LH wash-mode window complete, the embodiment would further include a lower frame wash mode cover-right handle 169.

Referring to FIG. 16A, FIG. 16B and FIG. 16C, in embodiments of the window complete where the window complete is either a LH wash-mode window complete or a RH wash-mode window complete, the window complete further includes additional features. For example, FIG. 16A illustrates a LH wash-mode window complete with a wash mode lever mechanism 160, a wash mode lockout mechanism 161, a lower cable block mechanism 163, a wash mode sliding drive mechanism 164, and various fasteners. Wash mode lever mechanism 160 is mounted to the lower platform base 24 using fasteners 199; and wash mode lockout mechanism 161 is mounted to lower platform base 24 using fasteners 200. Additional features of FIG. 16A include a rack and pinion gear set 109 which includes a pinion gear 110 that is mounted within the sliding housing base, and a rack 111 which is mounted and secured to the lower platform base with fasteners 112. In this embodiment, the outer ring gear teeth 67*b* of ring gear 67 of the planetary gear set 64 (all of which are not shown in FIG. 16A) is coupled to the rack and pinion gear set 109. Further shown in the embodiment of FIG. 16A are sliding drive mechanism 61, handle drive mechanism 79 which is mounted to the wider guide track of the lower platform unit via fastener 87, lockout mechanism 88, slotted pinion gear 90, and lock trigger mechanism 100 and various fasteners 87, 97, and 108.

FIG. 16B illustrates a LH wash-mode window complete further including a cable & sprocket drive mechanism 162 and an upper cable block 165 shown in FIG. 16C. As shown, the cable & sprocket drive mechanism includes a cable retainer 165*a*, a threaded hole 165*b*, and a locating pin 165*c* detail; and the upper cable block is mounted and secured to the fixed-slider shoe 35 of the upper link arm mechanism with fastener 166. When the upper cable block is so mounted, the fixed-slider shoe floats freely in the shoe guide track of the upper link arm mechanism. Referring now to FIG. 17A and FIG. 17B, embodiments of the disclosure are directed to an operating hardware for a wash-mode system added to a window complete as described above, further having multiple 4-sproket mechanism 174. As illustrated in exploded view FIG. 17A, each of a 4-sprocket mechanism includes a sprocket 175 with a hex aperture 175*a*, a sprocket base 176, a sprocket top 177, and fasteners 178 which secures the sprocket top cap and the sprocket to the sprocket base. In addition to the 4-sprocket mechanism, shown in FIG. 17B there are two (2) cable complete 179 each having a cable end connector (not shown), such that one pair of the sprocket mechanism places in tension the cable complete, mounted and secured to the upper frame section, and mounted and secured to the lower frame section with fasteners 180 and 184, respectively. Further, the hex shaft is placed in the hex aperture of the sprocket mechanism, when the sprocket mechanism is mounted and secured to the upper frame section and the lower frame section.

Also shown in FIG. 17B is lower cable block mechanism 163, including lower cable block 181, ball plunger fastener 182, and lock plate 183 which are discussed further in regards to FIG. 18B.

Referring now to FIG. 18A and FIG. 18B, an embodiment of the disclosure as detailed by FIG. 17B includes a lower cable block mechanism 163 as shown in assembled form in FIG. 18A. FIG. 18B shows an exploded view of cable block mechanism 163, including a lower cable block 181 having a cable retainer 181*a*, a sliding groove 181*b*, a threaded port 181*c*, a hook stop 181*d*, a mounting post 181*e*, and a hook post 181*f*. Further, the lower cable block mechanism includes a th ball plunger fastener 182 which is adjustable within the threaded port of the lower cable block, and a lock plate 183 which has a trigger post hook 183*a*, a latch bar hook 183*b*, an index engage notch 183*c*, and an index dis-engage notch 183*d*.

Referring now to FIG. 19A and FIG. 19B, embodiments of the disclosure are directed to an operating hardware for a wash-mode system added to a window complete as described above, further having a wash mode lockout mechanism as shown here. FIG. 19A shows an exploded view of wash mode lockout mechanism 161 according to an embodiment. As shown, wash mode lockout mechanism 161 includes a rod spring 192, a ball plunger fastener 193, and a lock bar 194 having a pair of index engage slot 194*a* and index dis-engage slot 194*b*, a pair of lever hook engage slot 194*c*, a lever hook dis-engage slot 194*d*, a cable block hook 194*e*, a lever rod hole 194*f*, a lock bar stop 194*g*, and a lock plate slot 194*h*. The wash mode lockout mechanism further includes a bar cap pc 195 with an upper slot 195*a* for the latch bar, a bar base piece 196 with a lower slot 196*a* for the latch bar, a hole and groove 196*b* for the rod spring, a threaded aperture 196*c* for the ball plunger fastener, and a threaded aperture 196*d* for a shoulder bolt fastener 197, and a bar hook 198. Further, bar hook 198 includes a hook end 198*a*, a trigger tab 198*b*, a spring aperture 198*c* for the rod spring, and a bolt aperture 198*d* for the shoulder bolt fastener, such that the bar cap piece is mounted to capture to the bar base piece with fastener 199, and the lever rod of the wash mode lever mechanism is mounted and secured to the lock bar hole of the wash mode lockout mechanism.

FIG. 19B illustrates an assembled view of the wash mode lockout mechanism of FIG. 19A and that the wash mode lockout mechanism is mounted to the lower platform base with fastener 200. FIG. 19B further illustrates wash mode lever 185, lever base 186, lever 187, lever rod 188, in addition to fastener 189.

According to an embodiment of the disclosure, the handle drive mechanism and the sliding drive mechanism is further re-configured with different gearing ratio set; first, to maximize the number of turns in exchanged for ease of rotation of the hand crank; and second, to set counterclockwise or clockwise rotation of the hand crank, with the direction of swing of the window sash.

Referring now to FIG. 20A, FIG. 20B, FIG. 20C, and FIG. 20D, transition between the operational mode to the locking mode, and back to the operational mode, is summarized into four (4) mechanical stages.

Figure 20A:
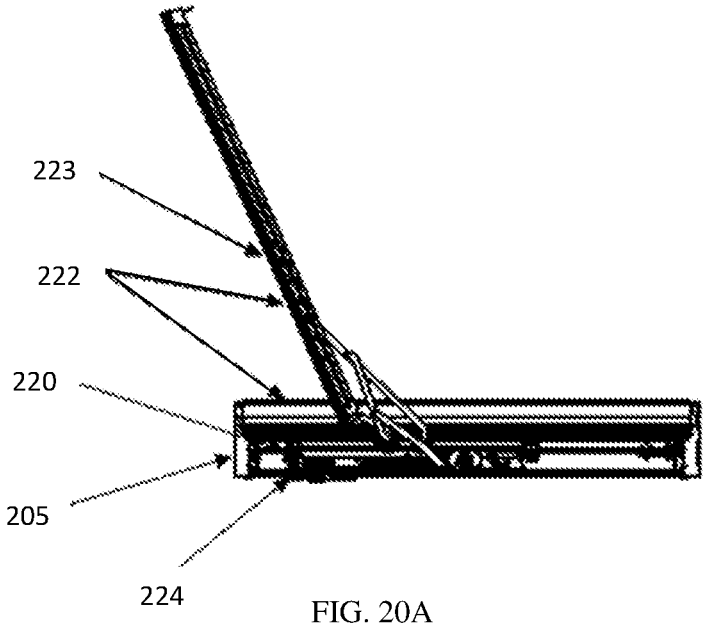

As shown in FIG. 20A, stage one 205 is when the window complete is in the operational mode. In order to move the window complete from stage one 205 into stage two 210 illustrated in FIG. 20B, first, the sliding latch mechanism is restricted and held in the full unlock status 206; second, the interlock key of the planetary gear set is fully restrained by the partially constructed guide rail of the lower platform base; and third, the rotational beginning stop of the planetary cap is held against the rotational beginning stop block of the slider housing base. Thus, all the hand crank rotational motion translated to the planetary gear set will direct motion to the ring gear, and the hand crank controls the window sash mechanically to swing from fully window open position 208, to nearly close position 209, wherein the nearly close position 209 is the location of the window sash having contact without compression of the window sash seal set, and the interlock key is NOT fully engaged with the slotted pinion gear.

Figure 20B:
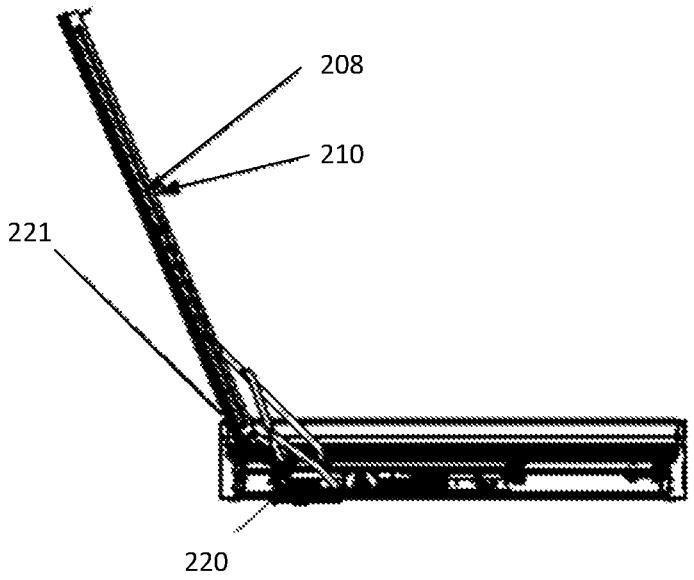

Further, at stage two 210, for transition and to allow transfer from the operational mode to the locking mode, additional closing rotation of the hand crank causes the window sash to swing from the nearly closed position, to reach a full window closed position 211 (shown in FIG. 20B). At full window closed position 211, several mechanical conditions result: first, the window sash compresses the window seal set; second, the tapper lead-in of the latch hook, aligns but does not engage with the roller fastener set of the slider latch mechanism; third, the interlock key is now fully engaged and aligned at position 212 within the slotted pinion gear, thereby removing the locking bar out of the slotted pinion gear, and with the slotted pinon gear now directly linked to the interlock key and consequently, any rotation of the interlock key results in direct rotation of the slotted pinion gear; and fourth, the interlock key is positioned into the partial gap in the guide rail, where, based on the mechanical concept of a planetary gear set, the input gear now directs rotational motion to either the base output gear or the "outer ring" output gear, depending on which direction the hand crank is rotated from this point on.

Further, end stop 213 of fastener set of the lockout mechanism is set to adjust and contact the sliding drive mechanism to set the final ending position 215 and to set the fully engaged and aligned interlock key for allowing back-pressure compression of the window sash seal set, and removing all internal tolerances of the window complete hardware.

Further, at stage three 216 (in FIG. 20D), with all the mechanical settings of the stage two, and with additional closing rotation of the hand crank, the input gear now directs rotational motion from the "outer ring" output gear to the base output gear, wherein the planetary cap rotates until the rotational beginning stop of the planetary cap reaches the rotational end stop of the planetary cap. At this point, with the short drive rack coupled to the slotted pinion gear, any rotation of the slotted pinion gear the short drive rack travels linearly until the rotational end stop of the planetary cap contacts the rotational end stop block of the sliding housing base. This results in the sliding latch mechanism engaging into the latch hook, pulling and compressing the window sash into the window sash seal set, thus, setting the window sash to a full lock status 217 and securely attaching the window frame to the window sash.

Furthermore, with the short drive rack, advancing linearly, and with the rack rod connecting the short drive rack to the threaded in-put end of the indicator block, and with the indicator output rod connected to the threaded out-put end of the indicator block and the hook end of the indicator output rod connecting to the horizontal input hole of the flexible metal strap within the corner strap mechanism, and the vertical output hole of the flexible metal strap connecting the corner output rod to first of several the latch plate of the sliding latch mechanism, any linear translation of the short drive rack, the roll pin fasteners of the indicator block, linked to the lock trigger lever, activates the LH lock trigger emblem or RH lock trigger emblem. This activation moves the respective emblem from displaying the "Green" color, to displaying the letters "LOCK" in the "Red" color.

Figure 20C:
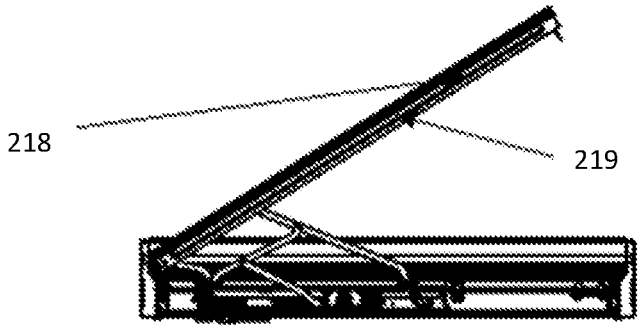
Figure 20D:
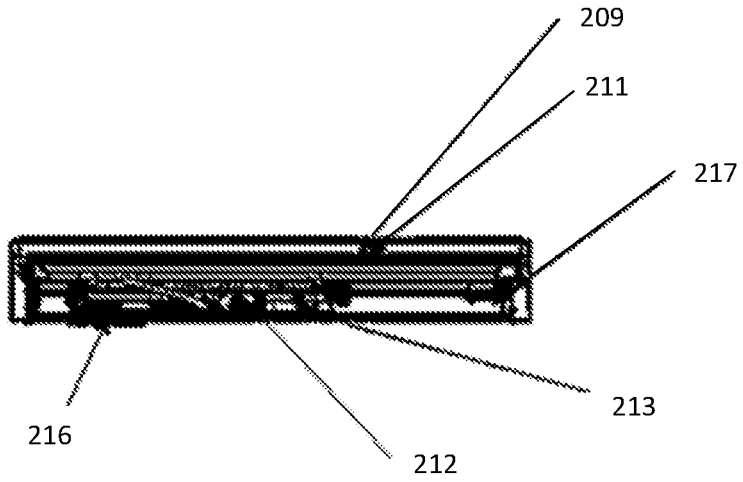

Further, as shown in FIG. 20C, at stage four 218, at the full lock status, transitioning from the locking mode to the operational mode is available by reverse opening rotation of the hand crank, causing the slotted pinion gear to rotate until rotational beginning stop of the planetary cap reaches and contacts the rotational beginning stop block of the slider housing base. At this point, the latch roller of the sliding latch mechanism retracts and completely dis-engages from the latch hook, wherein until the output#1 to transferred to output#2 the window sash remains in the full window closed position, negating any effects of the window sash seal set pressure. Any further reverse opening rotation of the hand crank transitions the output#1 to the output#2 when the rotational beginning stop of the planetary cap remains in contacts the rotational beginning stop block of the slider housing base, and thus the window sash swings to the nearly close position, completing transfer of the locking mode to the operational mode.

Further, as shown in FIG. 20C at stage five 219, in the operational mode, the wash mode lever of the wash mode lever mechanism is restricted from motion, until the window sash is positioned in the fully window open position; wherein the lever rod, connecting the wash mode lever to the latch bar, wherein the latch bar, is restricted from motion, until the bar hook dis-engages from the index lockout slot of the latch bar.

Further, at stage six 220, when at the fully window open position, the trigger block of the sliding drive mechanism mechanically dis-engages the bar hook when the trigger paw of the trigger block contacts and releases the restriction of the lock bar. This permits the wash mode lever of the wash mode lever mechanism to be manually pulled to engage the wash mode lockout mechanism. Accordingly, if at this position the wash mode level is not manually pulled, the window sash remains in the operational mode.

Further, once the wash mode level is manually pulled; first, the lock bar translates linearly from the index engage slot to the index dis-engage slot; second, the lock bar pulls the lock plate linked to the cable block hook of the lower cable block, locking the trigger post hook, of the lock plate, of the lower cable block mechanism to the trigger post of the trigger block; and third, the lock bar translates linearly until the cable block hook of the lock bar releases from the lower lock bar post of the lower cable block. Accordingly, the lower cable block mechanism is now coupled to the trigger block of the sliding drive mechanism.

Further, at stage seven 221, with the lower cable block mechanism firmly locked and coupled to the sliding drive mechanism, any rotation of the hand crank to close the window sash causes the sliding drive mechanism to travel linearly towards the end stop of the lockout mechanism. The window sash is now coupled securely at the fully open window position and traverses linearly, whereby each turn of the crank handle creates further separation between the window sash and the window frame edge. For window wash mode to occur a number of mechanical connections and disconnections occur. First, the bar hook is released to re-engage into the index engage slot of the lock bar whenever the window sash is removed from the hinge side frame section. At this point, the wash mode lever cannot be depressed until the window sash returns to the starting point of the wash mode, back to the hinge side frame position. Second, with the linear travel of the lower cable block mechanism, the cable completely traverses linearly and lower the sprocket rotates, thereby the vertical hex shaft rotates equally, wherein the upper the sprocket rotates equally, thereby the upper the cable complete traverses linearly, driving the upper cable block, couple to the fixed-slider shoe, equal to the same linear distance of lower the cable complete.

Further, when the sliding drive mechanism reaches the end stop of the lockout mechanism; the window sash is set at the full access 222 position, to reach the exterior glass side 223 for cleaning.

Further, at stage eight 224, to transition from the wash mode to the operational mode, the window sash needs to be positioned in the fully window open position such that the trigger block of the sliding drive mechanism mechanically engages into the wash mode lockout mechanism, and the lower cable block mechanism is aligned and position to permit the lock bar to engage when the wash mode lever is depressed.

Further, when the wash mode lever is depressed, the trigger bar of the trigger block, contacts and releases the hook of the bar hook, removing the restriction of the lock bar. First, the wash mode lever will be permitted to be depressed; and second, the fixed-slider shoe is now secured at the end of the platform base, thus translating the wash mode to be placed into the operational mode.

Referring to FIG. 21, an operating hardware of the instant disclosure is illustrated including mounting of a hand crank 129 having a handle mount bore 129 for attachment to the input shaft of the handle drive mechanism.

The claims represented in the present disclosure are based on integrating, replacing, and upgrading current window hardware as a system.

The present disclosure incorporates a single operating hand crank to control the operation mode, a locking mode, and a wash mode, thereby providing architects and home builders the option to place the hand crank in several locations onto the window lower frame section. This option provides a saving in both labor and inventory for both the original equipment manufacturer (OEM) hardware manufacturers and OEM window builders.

Additionally, the instant disclosure provides many benefits, such as having a single hand crank to control seamless transition between the operational mode to the locking mode without an issue of uneven or unsure rubberized seal pressure force. Another benefit presented herein is the innovative concept of a linear to rotational motion mechanism, as well as providing a planetary gear mechanism built into a complete hardware system. The integrated hardware system detailed herein provides a solution to use the same hand crank for the operational mode and the wash mode. Additionally, embodiments of the disclosure presents a solution for the issue seen in current hardware, namely that of having to hand control the window sash to clean both sides of a window's glass.

Additional benefits of the disclosed embodiments pertain to having a 4-bar scissor linkage, with the addition of a fifth link. Firstly, the instant disclosure provides an improvement in the way the window sash approaches the window frame for a softer or straighter approach to the sash sealing. This results in a longer sash seal life. Secondly, the disclosed embodiments provide removal of the larger slots within a typical window sash frame, resulting from moving the sliding guide track from the window sash frame to a platform base concept, the platform base mounted to the window frame.

An additional benefit of the disclosed embodiments includes an "eccentric cam" feature of the fifth linkage. The "eccentric cam" of the connection between the 4-bar linkage and the drive system allows a manual final adjustment when aligning the window's latch to the sash's hook. More specifically, the term "eccentric cam" refers to a cylinder style component where the outside diameter is not on the same axis as the inside diameter. When the cylinder style component is rotated, any components connected to the inside diameter, or the push link, will be shifted or moved in an amount of the differences in the two axes. Further, the term "eccentric" refers to the difference in the axes and "cam" refers to a lope or movement effect that happens upon rotation of the component.

This "eccentric cam" feature is innovative, as the industry needs something that provides a final adjustment that is not overly complicated and costly. The disclosed "eccentric cam" feature is simple and cost effective for a standard or factory-provided final adjustment and, if needed, allows for a subsequent simple method for an in-the-field readjustment.

Further benefits of the instant disclosure resulting from the innovative configuration of the hardware system being built on a platform base concept whereby several mechanisms are placed therein including a handle drive mechanism, are outline herein. Benefits of the handle drive mechanism include at least: (a) providing an option to relocate the handle drive mechanism to the left side, center, or right side on the window's lower frame; and (b) having the ability to change the bevel gear ratio set to accommodate ADA requirements.

Benefits of the disclosed sliding drive mechanism, so incorporated with a worm and wheel gear set include at least: (a) controlling all feedback forces coming from the window sash; and (b) creating the mechanical advantage of a linear to rotational motion for swinging open the window sash.

Benefits derived from the mechanical creation of having linear motion within the hardware system include at least: (a) a lockout mechanism that provides the mechanical connection of the planetary gear set to the operation of the locking/unlocking of the window sash; and (b) a visual indicator as to whether the window is locked or unlocked, thus alerting a window operator as to the actual locking status.

Benefits of adding a wash mode mechanism to the innovative platform base is found in the ability to use a same hand crank for operational mode and wash mode, and when the window is placed in the wash mode, the operator still maintains control of the window sash.

Further, benefits of the disclosure include providing a window hardware system that requires only three (3) different rod lengths to meet all the different window heights and one (1) different rod length to meet all the different window width sizes. Moreover, a majority of all components will be non-handed, non-upper or lower based, and as such the swing of the window sash (LH or RH) is determined at the point of sub-assembly built, where non-handed and non-upper components are rearranged to meet the swing of the window sash required.

The current disclosure provides hardware for a window complete with the advantage of having an operational mode, an unlocking mode, and a wash mode that are all controlled by the same hand crank.

The instant disclosure provides many advantages to architects and home builders compared to case windows in the present market. First, the advantage of providing three location options for the placement of the hand crank. That is, the hand crank can be placed near to the hinge edge, at the center, or near the latch edge of any width window. Second, the instant disclosure provides a hand crank transfer that is seamless from operational mode to locking mode. Third, French Window designs (double windows with no center structure) are able to have a single hand crank that can be used to open both window sashes at the same time. Fourth, embodiments of the disclosure have no exterior sash lock lever or lever bezel. The lock lever and lock bezel are removed from the window frame and replaced by a visible "LOCK" indicator in red color, or a solid green color indicator. This indicator location is on the horizontal, or optionally, on the vertical window frame, depending on preference or if hiding is required by window curtains. Double windows can have a lock indicator bezel on the center mullion vertical edge. Fifth, a hand crank controlling wash mode allows control over how far over the window sash (at maximum open) is pulled from the hinge edge (up to approx. 9"), thus providing access to reach the exterior of the sash glass for cleaning; Once the wash mode lever is pulled, the 4-bar linkage is locked solid and the window sash cannot scissor or swing between an open or closed position. Thus, the window sash can only transfer linearly and under the control of the hand crank. The window sash is highly resistant against normal weather conditions placed on the sash during the wash mode. The window sash, because of the hardware of this disclosure, is thus, never touched. This allows the operator full control. Additionally, it takes zero specialized knowledge to very little, general knowledge to enact the wash mode feature.

Another big benefit to architects and home builder is that the clockwise rotation and/or counterclockwise rotation can be geared into the hardware. That is, the window sash's swing can be set in the direction of the hand crank rotation; i.e. clockwise hand crank rotation for LH swing windows, and counterclockwise hand crank rotation for RH swing windows. Moreover, the total number of hand crank rotations, to open and closed, to lock and unlock the window, etc. can be altered, or the gearing ratios can be changed. That is, adding more number of hand crank rotations lowers the torque force to rotate the hand crank; i.e. for ADA requirement.

Further, window widths and heights of the disclosed embodiments are the same as current windows in the market today. The instant disclosure meets the same code conditions as current hardware. Also, window appearance and performance is improved; for example, having an optional folding hand crank.

Benefits of the disclosed improvements over presently used casement windows and their hardware as pertain to OEM window builders further include that the disclosed hardware does not require a change in current fabrication of the window frame and window sashes. Additionally, disclosed hardware requires merely simple inventory stocking, for the full range of window sizes. Also a completed LH window sash and a completed RH window sash are identical because a RH sash is essentially a LH sash just flipped 180 degrees. Further, a single mounting complete hardware system, includes one lower platform assembly, and one upper platform assemble, with only eight (8) fastening screws to secure the window sash to the window frame—regardless of window sizes.

Further, having a single hand crank for window swing and locking/unlocking provides an innovative, improved failsafe operating method by eliminating all mis-timing issues seen in other known attempts that try to integrate these operations. In particular, the concept of planetary gearing as disclosed herein, results in a seamless transition between unlock-to window opening-to window closing to locking. Moreover, no extra knowledge is necessary for a person operating a window with the newly invented wash mode. At a minimum, there is a fast learning curve that doesn't require expert or specialized knowledge.

Additionally, the new 5-bar linkage system, that is the 4-bar scissor linkage plus the fifth link, the push link, platform build results in a straighter approach during final closure of the window sash resulting in a straight squeezing force of the window seal. This translates to a longer seal life. Also, the addition of the fifth link provides a winder hinge support stance resulting in an increase in structural integrity against wind on the window sash. Further, the disclosed system switches the required sliding shoe from being in the window sash to the window frame; resulting in reduced cutout requirement in the window sash. In particular, a very short supporting "hinge" link increases bending loads (window weight) by 35%. All hardware necessary for the presently disclosed embodiments is configured to fit underneath and/or placed inside the window frame covers. Finally, only three (3) different rod length components are required to be in inventory in order to accommodate the full range of the window's width and height sizes.

Additional benefits of the disclosed embodiments provide particular benefits for OEM window hardware manufacturers as well. Firstly, a majority of all components are non-handed, non-upper/lower components for lowest possible cost; for molds, stamping dies, and machined parts and inventory (minimal SKU #). Secondly, once handed (LH or RH) at assembly, and once selection as Upper or Lower components, all sub-assemblies builds are the same regardless of the window's final width, and/or final height; and regardless of the type of window's sash or frame material construction. Thirdly, only three (3) different rod lengths and a different vertical hex shaft length are required to meet all the different height sizes, and one (1) different rod length is required to meet all different width sizes, thus requiring the same fabricated tooling and manufacturing labor and processes. Fourthly, all adjustments that's may be required, can be completed prior to shipping the present hardware, by the OEM Window Hardware Manufactures, i.e. prior to any installation onto the window's frame and/or sash at the OEM Window Manufacturers factory. Fifthly, components construction (mold, stamping, and machining) tolerances, by design, are such that manufacturing tolerances can be held for the lowest possible cost for the majority of components.

Further, regarding the disclosed platform build concept, a platform build for all window sizes, allows for one set of final testing equipment and fixtures. The platform is made as an extruded aluminum, hard anodized, providing smooth movement under max loading for all slider shoes and blocks. To build a wash mode configuration, ONLY requires adding components to the instant build to complete final platform assembly. All final adjusted can be tested prior to, and again after mounting to the window frame and sash. Also, the availability of different gearing ratio for number of hand crank rotation to open/close a window sash.

I claim:

1. Operating hardware for a window complete comprising:

an upper platform unit attached to a window frame, the upper platform unit comprising an upper platform base, an upper guide track, and an upper link arm mechanism configured to attach the upper link arm mechanism to a window sash;

a lower platform unit attached to the window frame, the lower platform unit comprising a lower platform base, a first lower guide track, a second lower guide track wider than the first lower guide track, and a lower link arm mechanism, wherein the lower link arm mechanism is attached to the window sash;

a sliding drive mechanism comprising a sliding housing base, a sliding housing top piece, a planetary gear set, and a worm and wheel gear set, wherein the planetary gear set is positioned between the sliding housing top piece and the sliding housing base, wherein the worm and wheel gear set comprises a wheel gear mounted to the planetary gear set, and a worm gear positioned between the sliding housing top piece and the sliding housing base and coupled to the wheel gear, and wherein the sliding housing top piece is secured to the sliding housing base; and a handle drive mechanism comprising an input bevel gear, a handle drive cap including a first hole for receiving the input bevel gear and a first half hole, an output drive gear, a handle drive base including a second hole for receiving the input bevel gear and a second half hole, and a handle drive shaft, wherein the output drive gear is mounted to the handle drive shaft and disposed within the first half hole and the second half hole;

wherein the handle drive mechanism is mounted to the second lower guide track of the lower platform unit; and wherein the sliding drive mechanism is configured to freely slide within the second lower guide track of the lower platform unit.

2. The operating hardware of claim 1, wherein the lower link arm mechanism comprises a 5-bar scissor linkage including a hinge link, a cross link, an outboard link, a sash link, and a push link, wherein the sash link is mounted to the window sash and attached to the hinge link, wherein a first slider shoe floats freely within the second lower guide track and attaches the outboard link to the cross link, wherein a fixed slider shoe is secured to the lower platform base and attaches the hinge link to the cross link; and wherein the push link is coupled to the cross link and to the sliding house base to provide a longer seal life for the window complete.

3. The operating hardware of claim 1, further comprising a hand crank mounted in a lower section of the window frame and the handle drive shaft, and configured to enable a seamless transition between three modes including an operation mode, a locking/unlocking mode, and a wash mode;

wherein the hand crank is a folding hand crank.

4. The operating hardware of claim 3, wherein the handle drive shaft is a handle hex drive shaft having a hexagonal shape and configured to insert into the output drive gear, wherein the hexagonal shape of the handle hex drive shaft enables transmission of torque from the hand crank to the handle drive system when a user turns the hand crank.

5. The operating hardware of claim 3, wherein the hand crank is configured to be positioned in multiple locations in the lower frame section of the window frame, including a left hand location, a center location, and a right hand location.

6. The operating hardware of claim 1, further comprising a lockout mechanism including an indicator block, a drive rack, a rack rod, a locking bar, a slotted pinion gear, and a lockout base, wherein the drive rack is coupled to the slotted pinion gear; and wherein the lockout mechanism is mounted to the lower platform base.

7. The operating hardware of claim 6, further comprising a lock trigger mechanism including a lock trigger base, a lock trigger cap, a lock trigger lever, and a lock trigger emblem, wherein the lock trigger lever is mounted to the lock trigger base by the lock trigger cap, and wherein the lock trigger emblem comprises a red color with letters "LOCK" printed thereover disposed on a first side of the lock trigger emblem and a green color disposed on a second side opposite the first side of the lock trigger emblem, and wherein when the red color is displayed showing the LOCK letters, the lock trigger mechanism indicates to a user that the window complete is in a locked position and the window sash cannot be opened.

8. The operating hardware of claim 7, further comprising a corner strap mechanism including a flexible metal strap, a corner base piece, and a corner cap piece, and an indicator output rod, wherein the corner cap piece is mounted to the lower frame section and a latch side frame section, wherein the flexible metal strap is secured between the corner base piece and the corner cap piece, wherein an indicator output rod is attached to the flexible metal strap on a first side and to the indicator block on a second side opposite the first side, and configured with different lengths determined by different window width sizes.

9. The operating hardware of claim 8, further comprising a multiple latching system having a number of sliding latch mechanisms based on the window height size and a corner output rod, wherein each of the number of sliding latch mechanisms is configured to mount to the latch side frame section, wherein the corner output rod couples a first side of a first sliding latch mechanism to the flexible metal strap of the corner strap mechanism and is configured with different lengths based on different window height sizes, and wherein, when the number of sliding latch mechanisms is more than one, the multiple latching system further comprises a latch rod configured with different lengths determined by the different window height sizes, wherein the latch rod couples a second side opposite the first side of the first sliding latch mechanism to a second sliding latch mechanism.

10. Operating hardware for a window complete for transition between three modes including an operation mode, a locking/unlocking mode, and a wash mode, the operating hardware comprising:

an upper platform track system attached to a window frame of the window complete, the upper platform track system comprising an upper platform base, an upper guide track, and an upper link arm mechanism configured to attach the upper link arm mechanism to a window sash;

a lower platform track system attached to the window frame, the lower platform unit comprising a lower platform base, a first lower guide track, a second lower guide track wider than the first lower guide track, and a lower link arm mechanism, wherein the lower link arm mechanism is attached to the window sash, wherein the lower link arm mechanism comprises a 5-bar scissor linkage including a hinge link, a cross link, an outboard link, a sash link, and a push link, wherein the sash link is mounted to the window sash and attached to the hinge link, wherein a first slider shoe floats freely within the second lower guide track and attaches the outboard link to the cross link, wherein a second slider floats freely to the lower platform base and attaches the hinge link to the cross link; and wherein the push link is coupled to the cross link and to the sliding house base;

a sliding drive system comprising a sliding housing base, a sliding housing top piece, a planetary gear system, and a worm and wheel system, wherein the planetary gear system is positioned between the sliding housing top piece and the sliding housing base, wherein the worm and wheel gear set comprises a wheel gear mounted to the planetary gear set, and a worm gear positioned between the sliding housing top piece and the sliding housing base and coupled to the wheel gear, and wherein the sliding housing top piece is secured to the sliding housing base; and a handle drive system comprising a hand crank, input bevel gear, a handle drive cap including a first hole for receiving the input bevel gear and a first half hole, an output drive gear, a handle drive base including a second hole for receiving the input bevel gear and a second half hole, and a handle drive shaft, wherein the hand crank is mounted in a lower frame section of the window frame, wherein the output drive gear is mounted to the handle drive shaft and disposed within the first half hole and the second half hole;

wherein the handle drive mechanism is mounted to the second lower guide track of the lower platform unit; and wherein the sliding drive mechanism is configured to secure to and freely slide within the second lower guide track of the lower platform unit.

11. The operating hardware of claim 10, wherein the hand crank is a folding hand crank and configured to be positioned in multiple locations in the lower frame section of the window frame, including a left hand location, a center location, and a right hand location.

12. The operating hardware of claim 10, wherein the output drive gear is an output hex drive gear configured to receive a hexagonally shaped component and the handle drive shaft is a handle hex drive shaft, wherein the hexagonal shape of the handle hex drive shaft enables a high transmission of torque from the hand crank to the handle drive system when a user turns the hand crank.

13. The operating hardware of claim 10, further comprising a lockout mechanism and a lock trigger mechanism, wherein the lockout mechanism includes an indicator block, a drive rack, a rack rod, a locking bar, a slotted pinion gear, and a lockout base, wherein the drive rack is coupled to the slotted pinion gear, and wherein the lockout mechanism is mounted to the lower platform base; and a lock trigger mechanism including a lock trigger base, a lock trigger cap, a lock trigger lever, and a lock trigger emblem, wherein the lock trigger lever is mounted to the lock trigger base by the lock trigger cap, wherein the lock trigger emblem comprises a red color with letters "LOCK" printed thereover disposed on a first side of the lock trigger emblem and a green color disposed on a second side opposite the first side of the lock trigger emblem, and wherein when the red color is displayed showing the LOCK letters, the lock trigger mechanism indicates to a user that the window complete is in a locked position and the window sash cannot be opened.

14. The operating hardware of claim 10, further comprising a corner strap mechanism including a flexible metal strap, a corner base piece, and a corner cap piece, and an indicator output rod, wherein the corner cap piece is mounted to the lower frame section and a latch side frame section, wherein the flexible metal strap is secured between the corner base piece and the corner cap piece, wherein an indicator output rod is attached to the flexible metal strap on a first side and to the indicator block on a second side opposite the first side, and configured with different lengths determined by different window width sizes.

15. The operating hardware of claim 14, further comprising a multiple latching system having a number of sliding latch mechanisms based on the window height size and a corner output rod, wherein each of the number of sliding latch mechanisms is configured to mount to the latch side frame section, wherein the corner output rod couples a first side of a first sliding latch mechanism to the flexible metal strap of the corner strap mechanism and is configured with different lengths based on different window height sizes, and wherein, when the number of sliding latch mechanisms is more than one, the multiple latching system further comprises a latch rod configured with different lengths determined by the different window height sizes, wherein the latch rod couples a second side opposite the first side of the first sliding latch mechanism to a second sliding latch mechanism.

16. The operating hardware of claim 15, wherein the shaft handle drive system and the planetary gear system have interchangeable gears that can be configured with different gear ratios to maximize a number of turns in exchange for ease of rotation of the hand crank, and to set a counterclockwise rotation or a clockwise rotation of the hand crank based on a direction of swing of the window sash.

* * * * *